US008712015B2

(12) United States Patent
Caiafa

(10) Patent No.: US 8,712,015 B2
(45) Date of Patent: Apr. 29, 2014

(54) ELECTRON BEAM MANIPULATION SYSTEM AND METHOD IN X-RAY SOURCES

(75) Inventor: Antonio Caiafa, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 406 days.

(21) Appl. No.: 13/223,036

(22) Filed: Aug. 31, 2011

(65) Prior Publication Data

US 2013/0051532 A1 Feb. 28, 2013

(51) Int. Cl.
*H05G 1/34* (2006.01)
*H05G 1/52* (2006.01)

(52) U.S. Cl.
USPC ..... 378/110; 378/114

(58) Field of Classification Search
USPC ..... 378/110–114
See application file for complete search history.

(56) References Cited

U.S. PATENT DOCUMENTS 4,578,767 A * 3/1986 Shapiro ..... 702/64
4,811,374 A * 3/1989 Kasa et al. ..... 378/96
5,822,395 A 10/1998 Schardt et al.
6,111,934 A 8/2000 Foerst et al.
6,292,538 B1 9/2001 Hell et al.
7,233,645 B2 * 6/2007 Feda ..... 378/102
7,409,043 B2 8/2008 Dunham et al.
7,839,979 B2 11/2010 Hauttmann et al.
2009/0129546 A1 * 5/2009 Newman et al. ..... 378/114
2010/0020937 A1 1/2010 Hautmann et al.
2010/0284509 A1 11/2010 Oreper

FOREIGN PATENT DOCUMENTS

WO 2008155695 1/2008

* cited by examiner

*Primary Examiner* — Irakli Kiknadze
(74) *Attorney, Agent, or Firm* — Fletcher Yoder, P.C.

(57) ABSTRACT

The embodiments disclosed herein relate to the controlled generation of X-rays and, more specifically, to the control of electron beams that are used to produce X-rays using one or more electron beam manipulation coils. For example, methods and devices for driving an electron beam manipulation coil, as well as systems using these devices, are provided. The systems are generally configured to maintain a first current though an electron beam manipulation coil using a first voltage source and to switch the first current to a second current using a second voltage source.

25 Claims, 13 Drawing Sheets

ELECTRON BEAM MANIPULATION SYSTEM AND METHOD IN X-RAY SOURCES

BACKGROUND

In non-invasive imaging systems, X-ray tubes are used in various X-ray systems and computed tomography (CT) systems as a source of X-ray radiation. The radiation is emitted in response to control signals during an examination or imaging sequences. Typically, the X-ray tube includes a cathode and an anode. An emitter within the cathode may emit a stream of electrons in response to heat resulting from an applied electrical current via the thermionic effect, and/or an electric field resulting from an applied voltage to a properly shaped metallic plate in front of the emitter. The anode may include a target that is impacted by the stream of electrons. The target may, as a result of impact by the electron beam, produce X-ray radiation and heat.

In such imaging systems, the radiation passes through a subject of interest, such as a patient, baggage, or an article of manufacture, and a portion of the radiation impacts a digital detector or a photographic plate where the image data is collected. In some X-ray systems the photographic plate is then developed to produce an image which may be used by a quality control technician, security personnel, a radiologist or attending physician for diagnostic purposes. In digital X-ray systems a photodetector produces signals representative of the amount or intensity of radiation impacting discrete elements of a detector surface. The signals may then be processed to generate an image that may be displayed for review. In CT systems a detector array, including a series of detector elements, produces similar signals through various positions as a gantry is rotated about a patient. In certain configurations, a series of these signals may be used to generate a volumetric image. Generally, the quality of the volumetric image is dependent on the ability of the X-ray source and the X-ray detector to quickly generate data as they are rotated on the gantry.

In other systems, such as systems for oncological radiation treatment, a source of X-rays may be used to direct ionizing radiation toward a target tissue. In some radiation treatment configurations, the source may also include an X-ray tube. X-ray tubes used for radiation treatment purposes may also include a thermionic emitter and a target anode that generates X-rays, such as described above. Such X-ray tubes or sources may also include one or more collimation features for focusing or limiting emitted X-rays into a beam of a desired size or shape. The X-ray source may be displaced about (e.g., rotated about) the target tissue while maintaining the focus of the X-ray beam on the tissue of interest, which allows a substantially constant X-ray flux to be provided to the target tissue while minimizing X-ray exposure to outlying tissue.

BRIEF DESCRIPTION

In one embodiment, a controller is provided having a control circuit. The control circuit includes an interface adapted to receive an electron beam manipulation coil of an X-ray generation system. The circuit also includes a first switching device coupled to a first voltage source and configured to create a first current path with the first voltage source toward the electron beam manipulation coil, a second switching device coupled to a second voltage source and configured to create a second current path with the second voltage source toward the electron beam manipulation coil, and a third switching device coupled to a first side of the interface and configured to allow conductance via the first current path and the second current path to the interface when the third switching device is in a closed position. The second and third switching devices are configured to create a third current path with the second voltage source when in respective open positions, and the third current path has an opposite polarity with respect to the second current path.

In another embodiment, an X-ray system is provided including an X-ray source having a cathode assembly configured to emit an electron beam and an anode assembly configured to receive the electron beam. The anode is adapted to generate X-rays in response to the received electron beam and the cathode assembly and anode assembly are disposed within an enclosure. The source also includes a plurality of electromagnetic coils disposed about the enclosure and configured to manipulate the electron beam by varying a dipole or quadrupole magnetic field generated by the plurality of coils, and a plurality of control circuits coupled to the plurality of electromagnetic coils. Each control circuit is coupled to one of the plurality of electromagnetic coils to independently control each coil. Each control circuit includes a first voltage source and a second voltage source. The control circuit is configured such that the first voltage source is used to maintain a current through each coil within a desired range to maintain the dipole or quadrupole magnetic field, and the second voltage source is used to increase or decrease the current through the coil to change the dipole or quadrupole magnetic field.

In a further embodiment, a method of driving an electron beam manipulation coil is provided. The method includes the steps of closing a first switching device to cause a first current at a first polarity to flow along a first current path from a first voltage source toward the electron beam manipulation coil, closing a second switching device to allow the first current to flow to the electron beam manipulation coil, opening the first switching device after closing the first and second switching devices to stop the flow of the first current to the electron beam manipulation coil and to form a current dissipation loop configured to reduce a magnitude of a current through the electron beam manipulation coil, and opening the second switching device and a third switching device to cause a second current at a second polarity to flow along a second current path from a second voltage source to the electron beam manipulation coil.

BRIEF DESCRIPTION OF THE DRAWINGS

These and other features and aspects of embodiments of the present invention will become better understood when the following detailed description is read with reference to the accompanying drawings in which like characters represent like parts throughout the drawings, wherein.

DETAILED DESCRIPTION

Figure 1:
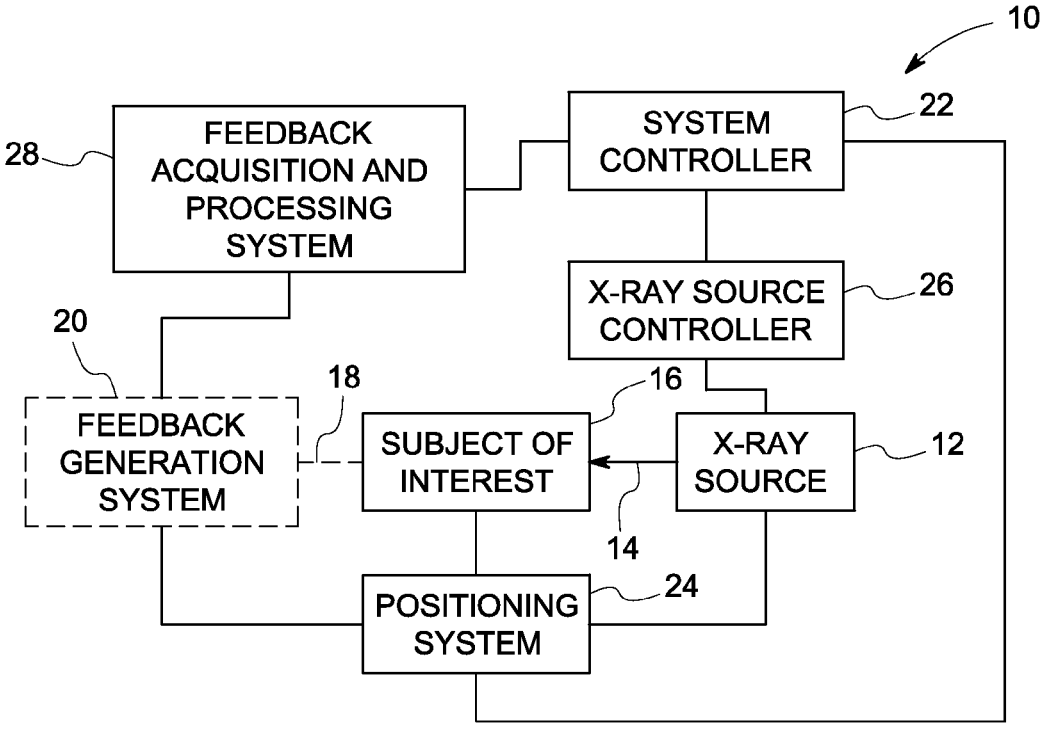
FIG. 1 is a block diagram illustrating an embodiment of a system that uses an X-ray source capable of emitting X-rays from multiple perspectives and/or at multiple energies.

In imaging and treatment modalities such as computed tomography (CT), X-ray fluoroscopy and/or projection imaging, X-ray radiation treatments, and the like, the quality of the examination/treatment procedures performed using X-ray producing sources may depend at least on the ability of the X-ray source to produce X-rays in a controlled manner. In certain X-ray sources, the electron beam that impacts the target anode to produce X-rays may be focused using a quadrupole magnetic field applied about the X-ray source. Such focusing may enable the focusing of variable energy X-ray emission, which can be useful for imaging different types of tissue and for providing varying levels of energy (e.g., in radiation treatment procedures). Further, steering the electron beam using a dipole magnetic field may allow the X-ray source to emit X-rays from substantially constant or varying positions on the anode, for example to generate stereoscopic and/or volumetric images. In configurations where it is desirable to emit the X-rays from varying positions on the anode and/or to focus the electron beam at different energies, the time delay between position changes or focal point maintenance may depend at least partially on the ability of the magnetic field that steers and/or focuses the electron beam to change its magnitude (e.g., orientation) and to interact with the electron beam.

To produce and change these magnetic fields, a current is typically passed through electron beam manipulation coils via a control circuit. The control circuit varies the current that flows through the coils, which in turn affects the magnetic field produced by each coil. Unfortunately, some control circuits suffer from slow transitions between currents, which can lead to lags in magnetic field magnitude change and, therefore, a lag in focusing strength and/or directional steering ability. Moreover, typical control circuits may control a plurality of electron beam manipulation coils in series, which does not allow for each coil to be addressed individually. These shortcomings may result in less-than optimal electron beam steering, which can affect X-ray emission and, therefore, the quality of a radiation treatment or a generated image.

The approaches described herein provide embodiments for rapidly changing a current magnitude through an electron beam manipulation coil. For example, in accordance with certain present embodiments, a control circuit is provided that includes a relatively low voltage source (e.g., 1 to 20 volts (V)) and a relatively high voltage source (e.g., 100 to 300 V). The control circuit includes various features for using the low voltage source to maintain an average current through the coil, and various features for using the high voltage source to rapidly switch between current levels. Additionally, certain of the disclosed embodiments provide control logic for regulating the operation of the control circuitry. The control logic may include features for regulating the base operational frequency of the control circuit, where the current through the electron beam manipulation coil is changed from relatively low current levels to relatively high current levels and high to low current levels. Additionally, the control logic includes features for regulating the current maintenance through the electron beam manipulation coil. Accordingly, the present embodiments may afford certain technical advantages over typical approaches including greater control over each electron beam manipulation coil, faster switching times, reliable X-ray emission, and fewer imaging artifacts.

Figure 2:
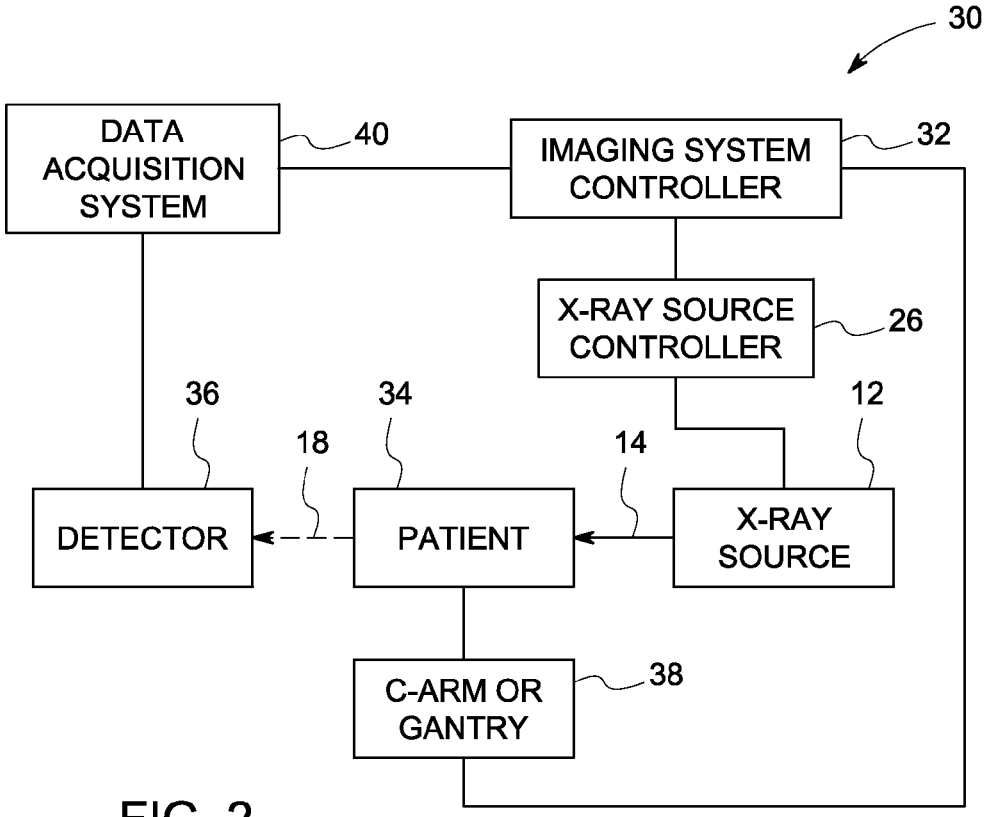
FIG. 2 is a block diagram illustrating an embodiment of an X-ray imaging system that uses an X-ray source capable of emitting X-rays from multiple perspectives and/or at multiple energies.

The approaches described herein may be used in the contexts mentioned above, which can include non-invasive imaging, surgical navigation, radiation treatment, and so on. Accordingly, FIGS. 1 and 2 provide non-limiting examples of systems that may include control circuitry and control logic in accordance with the present approaches. Specifically, FIG. 1 is a block diagram illustrating a general system 10 that uses an X-ray radiation source 12 for performing a quality control, security, medical imaging, surgical, and/or treatment procedure. The X-ray radiation source 12 may include one or more X-ray tubes each having features for producing X-ray radiation from more than one perspective and/or of more than one energy in a controlled manner as noted above. The X-ray source 12 therefore produces one or more streams of X-ray radiation 14 that are directed towards a subject of interest 16. The subject of interest may be baggage, cargo, an article of manufacture, a tissue of interest, and/or a patient. The X-ray radiation 14 is directed towards the subject of interest 16, where the X-ray radiation is attenuated to produce a beam of attenuated X-rays 18. The beam of attenuated X-rays 18 is captured by a feedback generation system 20 to produce signals representative of an image, or other information that may be useful for performing the procedure. Again, the data produced at the feedback generation system 20 may include data produced from receiving X-rays from a variety of positions and/or energies from each X-ray tube of the source 12.

A system controller 22 commands operation of the system 10 to execute examination, treatment and/or calibration protocols and to process the feedback. With respect to the X-ray source 12, the system controller 22 furnishes power, focal spot location, focal spot size, control signals and so forth, for the X-ray examination sequences. For example, the system controller 22 may furnish focal spot sizes and/or locations for X-ray emissions by the X-ray source 12. Additionally, in some embodiments, the feedback generation system 20 is coupled to the system controller 22, which commands acquisition of the feedback. As will be discussed in further detail below, the system controller 22 may also control operation of a positioning system 24 that is used to move components of the system 10 and/or the subject 16. The system controller 22 may include signal processing circuitry and associated memory circuitry. In such embodiments, the memory circuitry may store programs, routines, and/or encoded algorithms executed by the system controller 22 to operate the system 10, including one or more features of the X-ray source 12, and to process the feedback acquired by the generation system 20. In one embodiment, the system controller 22 may be implemented as all or part of a processor-based system such as a general purpose or application-specific computer system.

The source 12 may be controlled by an X-ray source controller 26 contained within or otherwise connected to the system controller 22. The X-ray controller 26 is configured to provide power and timing signals to the source 12. In some embodiments the X-ray source controller 26 may be configured to selectively activate the source 12 such that tubes or emitters at different locations within the system 10 may be operated in synchrony with one another or independent of one another. Moreover, in accordance with an aspect of the present disclosure, the X-ray source controller 26 may include a plurality of control circuits, with each control circuit connected to a respective electron beam manipulation coil to energize the coils proximate the X-ray tubes within the system 10. The control circuits, which energize the coils, may cause each tube to emit X-ray radiation from multiple perspectives and/or multiple energies using a dipole or quadrupole magnetic field. As will be discussed in detail below, certain embodiments may use a dipole magnetic field to change the perspective from which X-rays are emitted, while other embodiments may use a quadrupole magnetic field for controlling a focal spot size of electron beams of varying energies (e.g., to vary the energy of emitted X-rays).

As noted above, the X-ray source 12, which is controlled by the X-ray source controller 26, is positioned about the subject of interest 16 by the positioning system 24. The positioning system 24, as illustrated, is also connected to the feedback generation system 20. However, in other embodiments, the positioning system 24 may not be connected to the feedback generation system 20. The positioning system 24 may displace either or both of the X-ray source 12 and the feedback generation system 20 to allow the source 12 to image or treat the subject of interest 16 from a variety of positions. As an example, in a radiation treatment procedure, the positioning system 24 may substantially continuously displace the X-ray source 12 about the subject of interest 16, which may be a tissue of interest, while varying the energy of the X-ray radiation 14 emitted toward the tissue of interest. Moreover, the focal area of the X-ray radiation 14 may be maintained using quadrupole and/or dipole magnetic fields. In this way, the tissue of interest is provided with a substantially continuous flux of X-ray radiation while X-ray exposure to outlying tissues is minimized. Moreover, while some systems may not produce diagnostic images of the patient, the feedback generation system 20 may generate data relating to the position of the X-ray source 12 or other features, such as a surgical tool, relative to the tissue of interest, for example as an image and/or map. Such data may enable a clinician or other healthcare provider to ensure that the X-ray radiation 14 and/or the surgical tool is properly located with respect to the tissue of interest. The feedback generation system 20 may include a detector, such as a diode array, or a system that monitors the position of the source 12 and/or surgical tool relative to the subject of interest 16. Indeed, in certain embodiments, the feedback generation system 20 may include a detector and position-monitoring features that also provide feedback to the positioning system 24 either directly or indirectly.

To provide feedback to features of the system 10 that are not directly connected to or associated with the feedback generation system 20, the feedback generation system 20 provides data signals to a feedback acquisition and processing system 28. The feedback acquisition and processing system 28 may include circuitry for receiving feedback from the feedback generation system 20, as well as processing circuitry for manipulating the received data. For example, the processing circuitry may include signal converters (e.g., A/D converters), device drivers, processing chips, memory, and so on. In some embodiments, the feedback acquisition and processing system 28 converts analog signals received from the feedback generation system 20 into digital signals that can be further processed by one or more processing circuits (e.g., a computer-based processor) of the system controller 22.

One embodiment of system 10 is illustrated in FIG. 2, which is a block diagram of an embodiment of an X-ray imaging system 30, such as a CT or other radiographic imaging system. The system 30 includes an imaging system controller 32 for acquiring and processing projection data. The imaging system controller 32 also includes or is otherwise operatively connected to the X-ray source controller 26, which operates as described above. The X-ray source controller 26, as noted above, may also be operatively connected to a plurality of magnetic coils that are disposed proximate an X-ray tube of the source 12. Again, the controller 26 includes a plurality of control circuits, which each provide a series of voltage pulses to a magnetic coil to steer or focus an electron beam produced within the X-ray tube, which allows X-rays to be generated at various energies or in varying focal areas on a target anode of the X-ray tube.

Generally, the system 30 situates a patient 34 such that the X-ray beam 14 produced by the source 12 is attenuated by the patient 34 (e.g., various anatomies of interest) to produce the attenuated X-rays 18, which may be received by a photographic plate or a digital detector 36. In certain embodiments, the patient 34 may be situated in this manner using a patient table combined with a C-arm or gantry 38, which is controllably connected to the imaging system controller 32. Generally, the imaging system controller 32 may synchronize certain imaging sequence parameters, such as emissions from the source 12 with rotation rates of the source 12 and detector 36 about the gantry.

The data that is generated at the detector 36 upon receiving the attenuated X-rays 18 is provided, as above, to processing features such as the illustrated data acquisition system (DAS) 40. The DAS 40 generally converts the data received from the detector 36 into a signal that can be processed at the imaging system controller 32 (or other computer based processor). As an example, the detector 36 may generate analog data signals upon receiving the attenuated X-rays 18, and the DAS 40 may convert the analog data signals to digital data signals for processing at the imaging system controller 32. The data may be used to generate one or more volumetric images of various anatomies within the patient 34.

Again, the quality of the produced volumetric images may at least partially depend on the ability of the X-ray source 12 to emit X-rays in a controlled manner. For example, the ability of the X-ray source 12 to quickly (e.g., on a milli- or microsecond timescale) change between emitting X-rays from different perspectives or at different energies may enable the formation of volumetric images having fewer artifacts and higher resolution than images produced when such functionality is not present. For example, a first image may be generated using X-rays of a first energy, and a second image may be generated using X-rays of a second energy. The first and second images, being collected at different energies, may be further processed, for example to obtain soft tissue information, bone tissue information, or the like. In certain embodiments, such as when the source 12 is rotating about the patient, it may be desirable to capture the X-ray attenuation data at the first and second energies as quickly as possible to provide a more accurate comparison between the two resulting images or sets of attenuation data. Indeed, the imaging system controller 32 and the X-ray source controller 22 in accordance with the present embodiments may be configured to generate multiple sets of X-rays (e.g., from different perspectives or at different energies) within about 1 to about 1000 microseconds of one another. Indeed, the present embodiments may enable X-ray emission at multiple energies within about 1 to about 750 microseconds, about 1 to about 500 microseconds, about 10 to about 250 microseconds, about 10 to about 100 microseconds, or about 20 to about 50 microseconds of one another.

Figure 3:
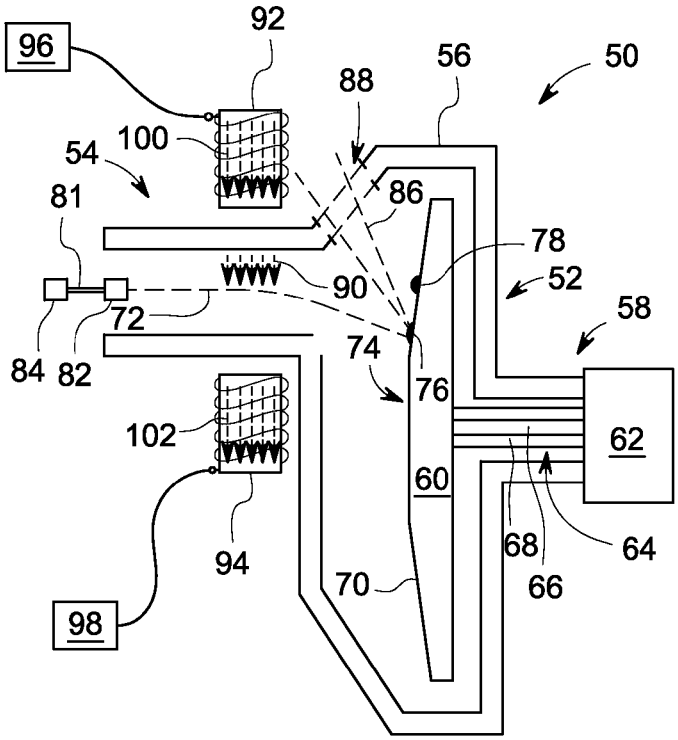
FIG. 3 is a schematic view of an embodiment of an X-ray tube configured to emit X-rays from multiple perspectives.

With the foregoing in mind, FIG. 3 illustrates an embodiment of an X-ray tube 50 that includes features configured to provide X-ray emission from multiple perspectives using a dipole magnetic field. Specifically, FIG. 3 illustrates the X-ray tube 50 as emitting X-ray radiation from a first perspective, with the capability of emitting X-ray radiation from a second perspective. As noted above, the present embodiments are applicable in the context of a quadrupole magnetic field configured to change the size (e.g., diameter) of an electron beam, which is described with respect to FIGS. 4-8. Referring now to FIG. 3, The X-ray tube 50 includes an anode assembly 52 and a cathode assembly 54. The X-ray tube 50 is supported by the anode and cathode assemblies within a conductive or non-conductive housing 56 defining an area of relatively low pressure (e.g., a vacuum) compared to ambient. For example, the housing 56 may include glass, ceramics, or stainless steel, or other suitable materials.

The anode assembly 52 generally includes rotational features 58 for causing rotation of an anode 60 during operation. The rotational features 58 may include a rotor and stator 62 for driving rotation, as well as a bearing 64 that supports the anode 60 in rotation. The bearing 64 may be a ball bearing, spiral groove bearing, or similar bearing. In general, the bearing 64 includes a stationary portion 66 and a rotary portion 68 to which the anode 60 is attached.

The front portion of the anode 60 is formed as a target disc having a target or focal surface 70 formed thereon. In accordance with an aspect of the present disclosure, the focal surface 70 is struck by an electron beam 72 at varying distances from a central area 74 of the anode 60. In the embodiment illustrated in FIG. 3, the focal surface 70 may be considered to be struck at a first position 76, while being struck in a second position 78 as the dipole magnetic field is changed, as discussed below.

The anode 60 may be manufactured of any metal or composite, such as tungsten, molybdenum, copper, or any material that contributes to Bremsstrahlung (i.e., deceleration radiation) when bombarded with electrons. The anode's surface material is typically selected to have a relatively high refractory value so as to withstand the heat generated by electrons impacting the anode 60. The space between the cathode assembly 54 and the anode 60 may be evacuated in order to minimize electron collisions with other atoms and to maximize an electric potential between the cathode and anode. Moreover, such evacuation may advantageously allow a magnetic flux to quickly interact with (i.e., steer or focus) the electron beam 72. In some X-ray tubes, voltages in excess of 20 kV are created between the cathode assembly 54 and the anode 60, causing electrons emitted by the cathode assembly 54 to become attracted to the anode 60.

Control signals are conveyed to cathode 82 via leads 81 from a controller 84, such as the X-ray controller 26. The control signals cause a thermionic filament of the cathode 82 to heat, which produces the electron beam 72. The beam 72 strikes the focal surface 70 at the first position 76, which results in the generation of a first set of X-ray radiation 86, which is diverted out of an X-ray aperture 88 of the X-ray tube 50. The first set of X-ray radiation 86 may be considered to have a respective first direction, or, in other contexts, a respective first energy, as is discussed in detail below. The direction, orientation, and/or energy of the first set of X-ray radiation 86 may be affected by the angle, placement, focal diameter, and/or energy at which the electron beam 72 impacts the focal surface 70.

Some or all of these parameters may be affected and/or controlled by a magnetic field 90 within the housing 56, which is produced outside of the X-ray tube 50. For example, first and second magnets 92, 94, which are disposed outside of the X-ray tube housing 56, may produce the dipole magnetic field 90. In the illustrated embodiment, the first and second magnets 92, 94 are each connected to respective controllers 96, 98. The controllers 96, 98 each provide electric current to the first and second magnets 92, 94, and may include or be a part of the system controller 22 or the X-ray controller 26 discussed above in FIGS. 1 and 2. As the electrical current is passed through the first and second magnets 92, 94, respective first and second magnetic fields 100, 102 are produced. The first and second magnetic fields 100, 102 both contribute to the dipole magnetic field 90 within the housing 56.

Figure 4:
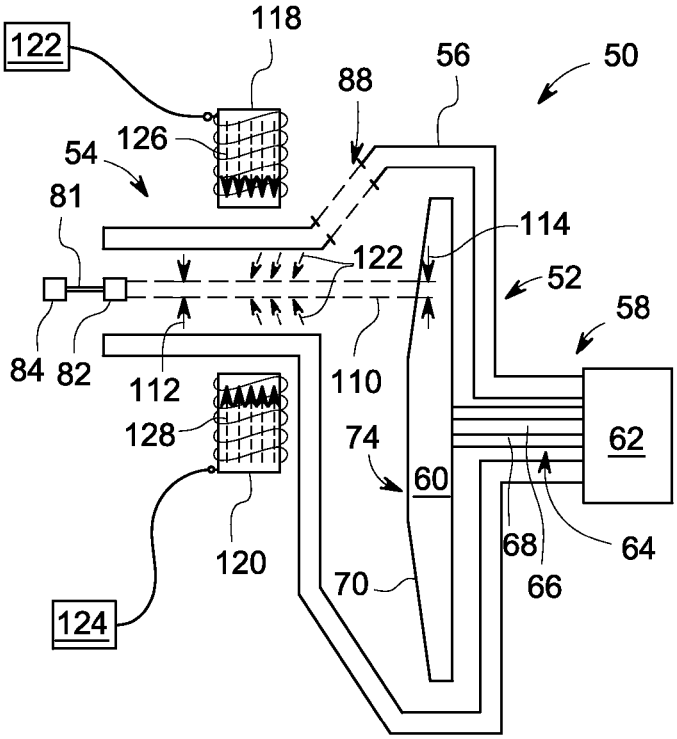
FIG. 4 is a schematic view of an embodiment of an X-ray tube configured to emit X-rays at various energies.

Thus, the first set of X-ray radiation 86, which may form all or a portion of the X-ray beam 18 of FIGS. 1 and 2, exits the tube 50 and is generally directed towards a subject of interest from the first perspective during examination and/or treatment procedures. As noted above, switching the magnitude (e.g., strength, orientation) of the externally generated magnetic field 90 that is applied across the tube 50 may vary the direction or focusing strength at which X-rays are emitted from the X-ray tube 50. FIG. 4 illustrates an embodiment of the X-ray tube 50 where the cathode assembly 54 is configured to produce an electron beam 110 at varying energies. The electron beam, at a first energy, has a diameter 112. The diameter 112 of the electron beam 110 may at least partially determine a focal area 114 of the anode 60 that is bombarded with the electron beam 110. As the diameter 112 of the electron beam 110 varies, the focal area 114 on the target anode 114 may change. However, in some embodiments, it may be desirable to maintain the diameter of the electron beam 110. Accordingly, the illustrated embodiment of the X-ray tube 50 includes features for maintaining the diameter 112 of the electron beam 110 to maintain the focal area 114 on the anode 60.

Specifically, the embodiment of the X-ray tube 50 illustrated in FIG. 4 includes the same tube features as the X-ray tube 50 of FIG. 3. However, the tube 50 is surrounded by a first and second magnet 118, 120, which constitute a portion of a plurality of magnets (e.g., four or more magnets) that are configured to produce a quadrupole magnetic field 122. The quadrupole magnetic field 122 may be used to vary the diameter 112 of the electron beam 110, or to keep the diameter 112 of the electron beam 110 substantially constant as the energy of the electron beam 110 changes. The first and second magnets 118, 120 are each connected to controllers 122, 124, which enable the production of respective magnetic fields 126, 128. The operation of the quadrupole magnetic field 122 is discussed with respect to FIGS. 5-8.

Figure 5:
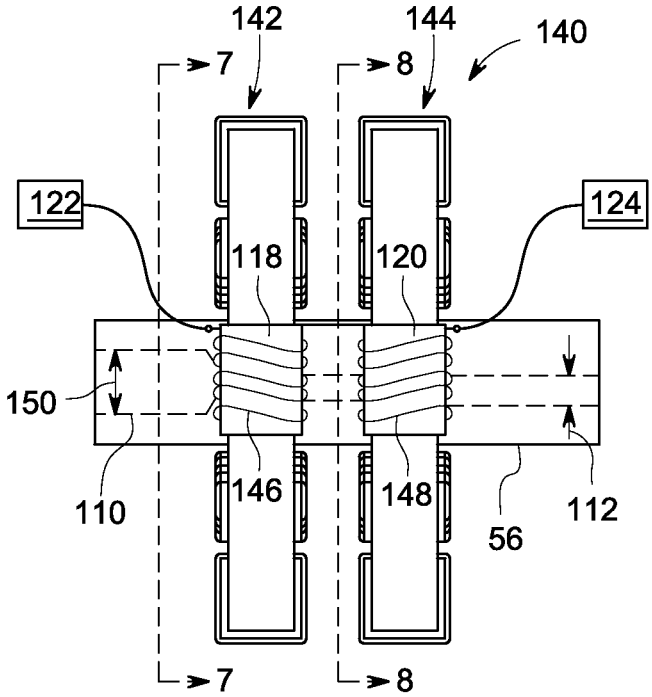
FIG. 5 is a schematic view of an embodiment of an arrangement of electron beam manipulation coils disposed about an enclosure of an X-ray tube.

Specifically, FIG. 5 illustrates an embodiment of a magnet arrangement 140 having a first plurality of magnets 142 and a second plurality of magnets 144 disposed in an annular arrangement about the housing 56. Accordingly, in some embodiments, the first and/or second plurality of magnets 142, 144 may be arranged in a full or partial circle about the housing 56. In the illustrated embodiment, the first and second plurality of magnets 142, 144 are disposed concentrically about the housing 56. Such an arrangement may facilitate the manipulation of the diameter 112 of the electron beam 110. In accordance with certain of the present embodiments, each of the magnets may be connected to a control circuit, which allows independent control of each electromagnetic coil of each magnet. Such a configuration may be desirable to allow for manufacturing tolerances, such as magnetic inhomogeneities and pole misalignment. As an example, the first magnet 118 is included in the first plurality of magnets 142, and includes a first magnetic coil 146 operatively connected to the first controller 122, which, as discussed in further detail below, includes at least a control circuit and control logic that controls the operation of the control circuit. Likewise, the second magnet 120 is illustrated as one of the second plurality of magnets 144 and has a second magnetic coil 148 that is operatively connected to the second controller 124. As noted above with respect to FIG. 4, the quadrupole magnetic field (or fields) generated by the first and second plurality of magnets 142, 144 operates to adjust the diameter 112 of the electron beam 110.

In FIG. 5, the electron beam 110 is illustrated as being emitted at a first energy, which results in a first diameter 150. As the electron beam encounters the quadrupole magnetic field generated by the first plurality of magnets 142, the beam 110 is compressed in a first direction. That is, the electron beam 110 is compressed along, for example, an x- or z-axis, where the y-axis of the beam 110 is along the enclosure 56. The extent to which the electron beam 110 is compressed in the first direction is dependent at least upon the first energy of the electron beam 110, the intensity of the electron beam 110, and the strength of the quadrupole field. Similarly, the electron beam 110 is compressed in a second direction to the desired diameter 112 as the quadrupole field of the second plurality of magnets 144 acts on the beam 110.

Figure 6:
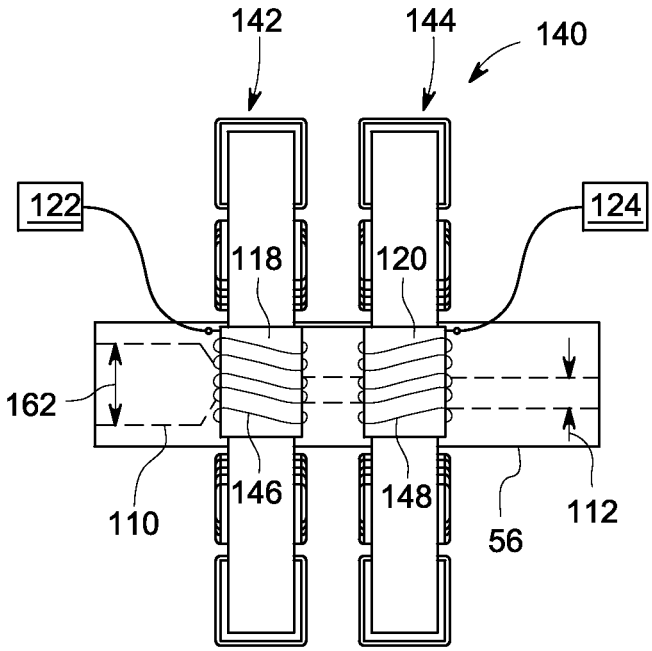
FIG. 6 is a schematic view of the embodiment of the arrangement of FIG. 5 where the electron beam manipulated by the beam manipulation coils is at a second energy.

In FIG. 6, the electron beam 110 is emitted at a second energy. In the illustrated embodiment, the second energy of the electron beam 110 is greater than the first energy of the electron beam 110, which results in a second diameter 162. Because the second energy is greater than the first energy, the second diameter 162 differs from the first diameter 150. Accordingly, to compensate for the energy variation to generate the desired diameter 112 at the second energy, the quadrupole magnetic fields generated by the first and second plurality of magnets 142, 144 are varied. In accordance with the present embodiments, the magnitude of the quadrupole fields are varied using each control circuit connected to each magnetic coil. Accordingly, the second diameter 162 is compressed in the first direction by the first plurality of magnets 142 by varying the current provided to each of the coils using their respective control circuits. For example, to provide a greater force to compress a higher energy electron beam, a higher current may be passed through each of the magnetic coils. The electron beam 110 is then compressed in the second direction to generate the desired diameter 112 at the second energy.

It should be noted that while the present embodiment is described in the context of increasing magnetic field strength to compress the electron beam 110 as its energy is increased, that the strength of the magnetic field used to produce the desired diameter of the electron beam may also depend on the intensity of the electron beam and the distance along which the electron beam travels between the emitter and the target anode. Thus, in certain embodiments, such as for certain focusing distances and certain electron beam intensities, the magnetic field suitable for compressing an electron beam at higher energy may be less than the magnetic field suitable for compressing the same electron beam at a lower energy. Such electron beam manipulation may allow the provision of X-rays of varying energies to a subject of interest at a substantially constant focal size, for example to allow the production of images with varying contrast and/or attenuation. Moreover, it should be noted that while the first plurality of magnets 142 and the second plurality of magnets 144 about the tube 50 are presently discussed in the context of compressing the electron beam 110 in only one direction each, in some embodiments, the electron beam 110 may be compressed from both directions with either plurality of magnets 142, 144.

Figure 8:
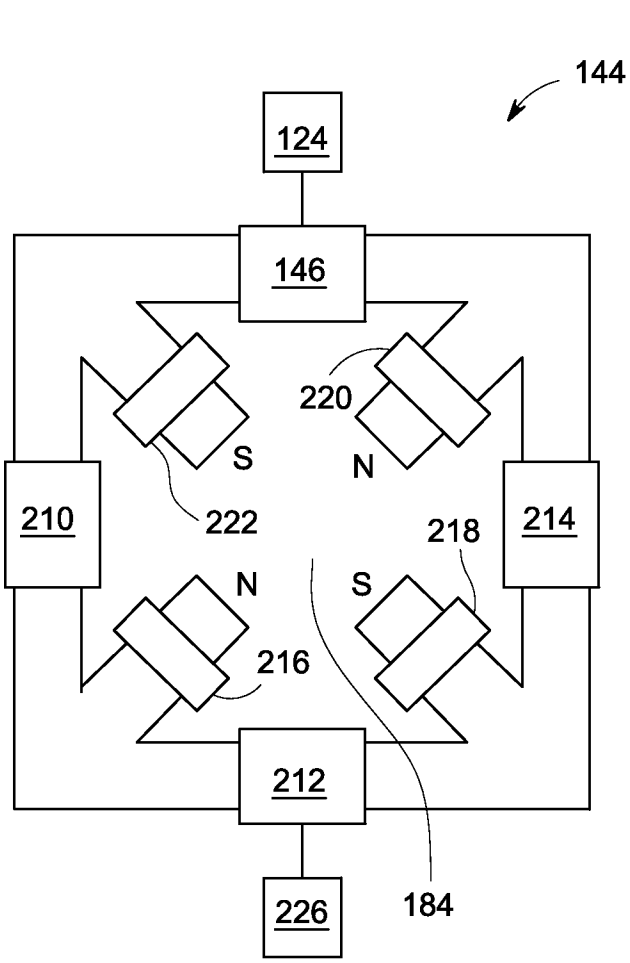
FIG. 8 is an end-on view taken along line 8-8 of a portion of the embodiment illustrated in FIG. 5.
Figure 7:
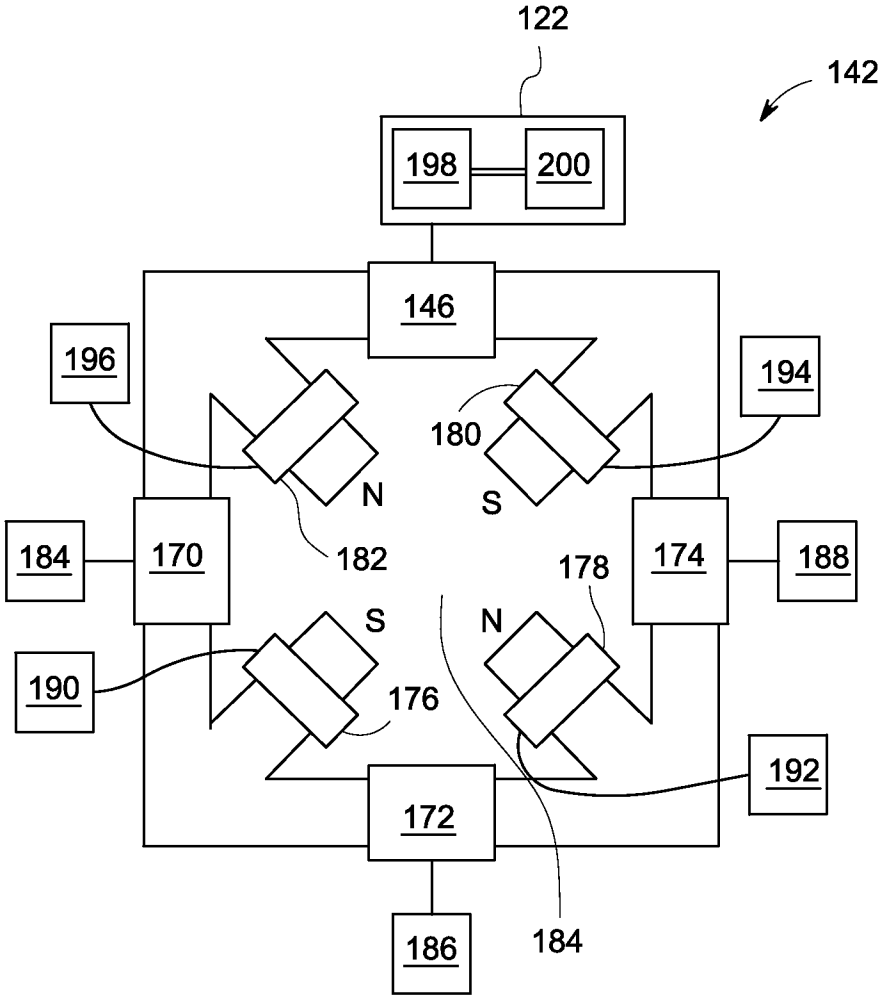
FIG. 7 is an end-on view taken along line 7-7 of a portion of the embodiment illustrated in FIG. 5.

The directional compression of the electron beam 110 may be further appreciated with reference to FIGS. 7 and 8, which are end-on views from line 7-7 and 8-8, respectively, in FIG. 5. Referring now to FIG. 7, an embodiment of the first plurality of magnets 142 from FIGS. 5 and 6 is illustrated as being energized to generate a first quadrupole field. The first quadrupole field generated by the first plurality of magnets 142, as noted above, is adapted to compress the electron beam 110 in a first direction (e.g., the x-direction). As depicted, the first plurality of magnets 142 includes coils 170, 172, 174, 176, 178, 180, and 182 as surrounding a central portion 184 of the arrangement 140. Each coil 146, 170-182 is operatively coupled to a respective controller 122, 184, 186, 188, 190, 192, and 194. Each controller 122, 184-194 includes at least one respective control circuit operatively coupled to a control logic device.

For example, the first coil 146 is illustrated as coupled to the controller 122, which includes a control circuit 198 for providing a current and voltage pulses to the coil 146 to generate a desired magnetic field. The operation of certain features within the control circuit 198 (e.g., switching devices) is controlled by a control logic 200. The control logic 200 produces a series of logic outputs to adjust the operation of the control circuit 198 and, therefore, the magnitude of the magnetic field generated by the coil 146. It should be noted that while the controller 122 is illustrated as having a single connection to the first coil 146, that the control circuit 198 of the controller 122 may have an interface that couples to both ends of the coil 146. Such a configuration is discussed below with respect to FIGS. 11, 13, 15, and 17.

In FIG. 8, the second plurality of magnets 144 is depicted as generating a second quadrupole field to compress the electron beam 110 in a second direction (e.g., the z-direction). As illustrated, the plurality includes the second coil 148 as well as coils 210, 212, 214, 216, 218, 220, and 222. As discussed above with respect to the first plurality of magnets 142, each coil is operatively coupled to a respective controller, each of which includes at least one control circuit operatively coupled to a control logic device. As discussed above, each controller is generally configured to energize the coils to generate a magnetic field. In accordance with the present embodiments, the control circuits may be adapted to vary the current through the coils to vary the magnetic field generated by each.

Figure 9:
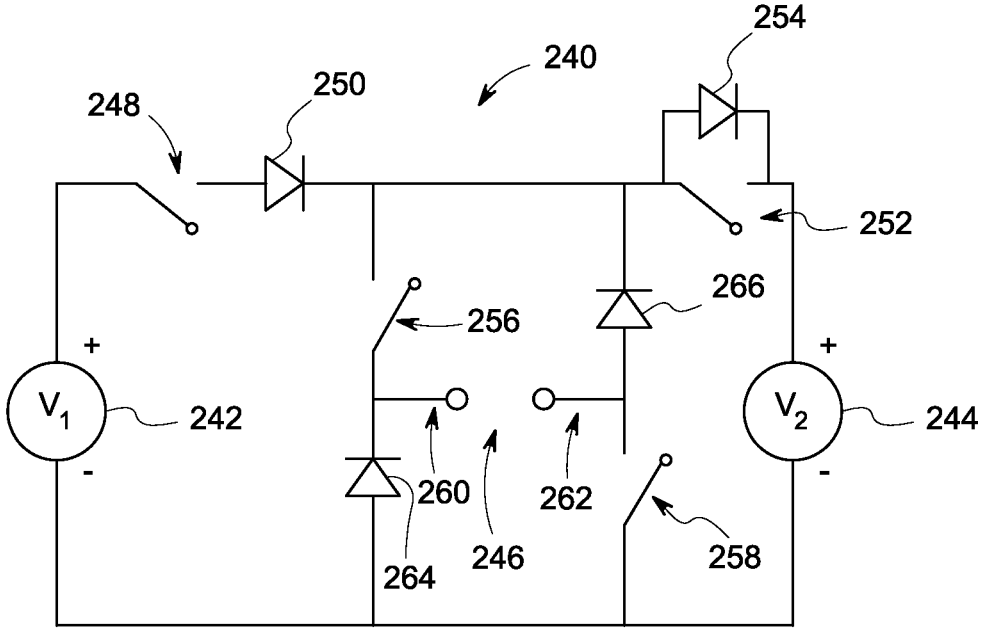
FIG. 9 is a circuit diagram illustrating an embodiment of a control circuit for driving an electron beam manipulation coil.

FIG. 9 is a circuit diagram of an embodiment of a control circuit 240 adapted to receive an electron beam manipulation coil. For example, the control circuit 240 may be the control circuit 198 in FIG. 7, or any control circuit for driving the current through an electron beam manipulation coil. The control circuit 240, in a general sense, is adapted to use a first voltage source 242 for maintaining a current through the electron beam manipulation coil. The control circuit 240 is also adapted to use a second voltage source 244 for making adjustments to the current flowing through the coil, for example to induce a change in the magnetic field produced by the coil (e.g., to change its magnitude).

The control circuit 240 includes an interface 246 for electrically coupling to an electron beam manipulation coil, and also includes a series of switching devices disposed between the voltage sources 242, 244 and the interface 246 for manipulating the current through the coil. Specifically, the control circuit 240 includes a first switching device 248 coupled to and electrically downstream of the first voltage source 242. In a general sense, the first switching device 248, when in a closed position, forms a first current path that enables a first current to flow toward the interface 246. A first diode 250 is disposed electrically downstream of the first switching device 248 to prevent current backflow during operation of the circuit 240. Specifically, the first diode 250 prevents a current flow from the second voltage source 244 to the first voltage source 242, which can damage the control circuit 240.

Similarly, a second switching device 252 is coupled to and disposed electrically downstream of the second voltage source 244. Like the first switching device 248, the second switching device 252, when in a closed position, forms a second current path that enables a second current to flow toward the interface 246. As will be discussed in further detail below, a second diode 254 is provided in parallel with the second switching device 252 to allow a unidirectional current flow along a current path having an opposite polarity compared to the second current.

The circuit 240 also includes third and fourth switching devices 256, 258, which are provided in parallel on opposite sides of the interface 246. Specifically, the third switching device 256 is disposed on a first side 260 of the interface 246 and the fourth switching device 258 is disposed on a second side 262 of the interface 246. The third switching device 256, when in a closed position, enables conductance from the first voltage source 242, through the first switch 248 (when in a closed position), and to the interface 246. Additionally, the third switching device 256, when in the closed position, enables conductance from the second voltage source 244, through the second switching device 252 (when in a closed position), and to the interface 246. In some embodiments, the timing by which the first switching device 248 and the second switching device 252 are controlled is such that when one switching device is in the closed position, the other is not. However, such a configuration may not be present in other embodiments.

As is discussed in further detail below with reference to the operation of the circuit 240, the circuit 240 also includes a third diode 264 to enable unidirectional current flow to the interface 246 from the second voltage source 244. The circuit 240 further includes a fourth diode 266 that enables unidirectional flow from the interface 246 and to the second voltage source 244, for example during a current reduction procedure.

Figure 10:
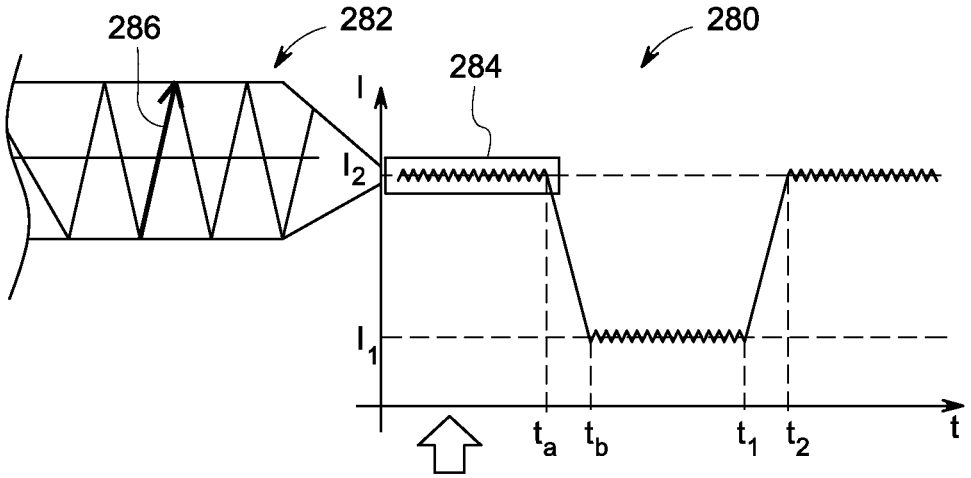
FIG. 10 is a plot illustrating an embodiment of a current profile through an electron beam manipulation coil as a function of time and an expanded view of a portion of the plot corresponding to the maintenance of an average current through the electron beam manipulation coil.

FIG. 10 illustrates an embodiment of a profile 280 of current flowing through an electron beam manipulation coil as a function of time. The profile 280 includes a low current level, indicated as $I_1$, and a high current level, indicated as $I_2$. In the profile, the current starts at $I_2$, and is maintained at a global average maximum current using a current maintenance procedure where, as discussed below, the first switching device 248 is oscillated between open and closed positions. This enables the current flowing through an electron beam manipulation coil to be lower than would be obtained if the first switching device 248 remained in the closed position. The current is then reduced to a global average minimum current, $I_1$, using a current reduction procedure, and returned to $I_2$ using a current increasing procedure. As is discussed in detail below, the current reduction and increasing procedures are performed using the second, third, and fourth switching devices 252, 256, 258. The operation of the control circuit 240 is discussed below with respect to FIGS. 11-17 and with reference to the profile 280.

An expanded view 282 of box 284 is also illustrated in FIG. 10. Specifically, the expanded view highlights the current profile during the current maintenance procedure performed by the first switching device 248. As depicted by an arrow 286, the current maintenance procedure includes a period at which the current flowing through the electron beam manipulation coil increases at a first rate. The configuration of the control circuit 240 during this period is illustrated in FIG. 11.

Figure 11:
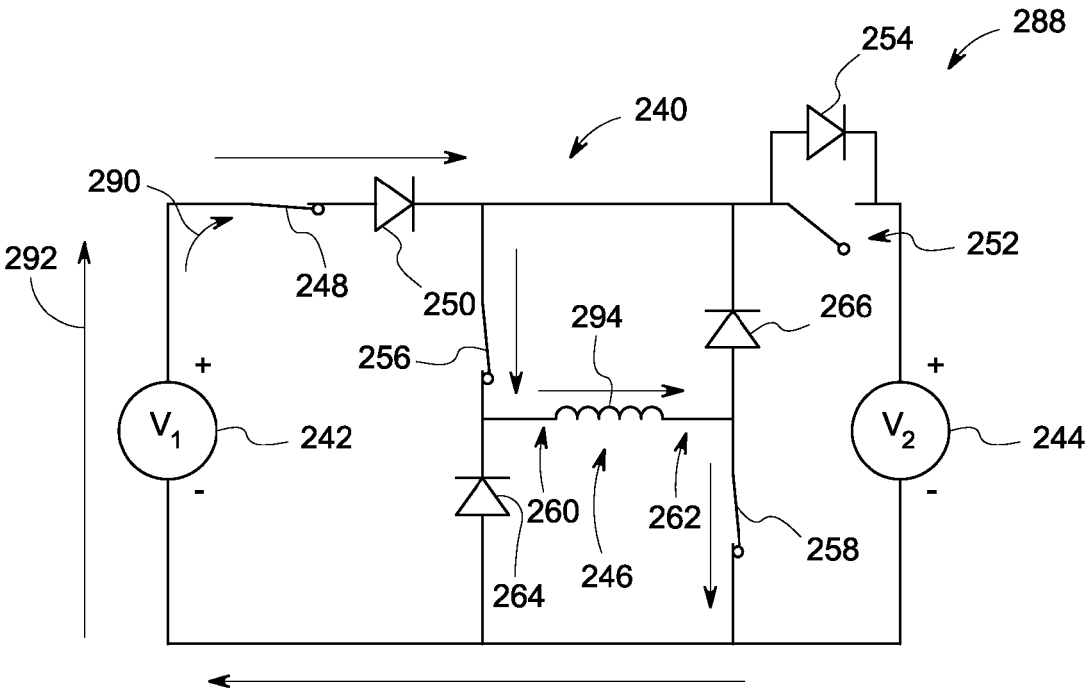
FIG. 11 is a schematic illustration of an embodiment of the control circuit of FIG. 9 in a configuration that causes a first current to pass through an electron beam manipulation coil.

Specifically, FIG. 11 depicts a control circuit-coil arrangement 288 as having the first switching device 248, the third switching device 256, and the fourth switching device 258 in respective closed positions. As noted above, the first switching device 248, in its closed position, creates a first current path 290, which flows a first current 292 toward an electron beam manipulation coil coupled to the interface 246. The closed positions of the third and fourth switching devices 256, 258 enable the first current 292 to flow to the electron beam manipulation coil 294. Therefore, conductance is enabled between the first voltage source 242 and the electron beam manipulation coil 294, forming a first current loop. In the illustrated embodiment, the first current loop is depicted as arrows representing the first current 292. It should be noted, however, that the current into the electron beam manipulation coil may be reduced compared to the desired value due to the parasitic resistance of the electron beam manipulation coil 294 and other lossy mechanisms including, but not limited to, voltage drops across the switching devices. Therefore, a voltage of the first voltage source 242 may be such that the voltage is at least R*I, which is the product of the desired current through the coil 294, I, and the parasitic resistance of the coil 294, R. In accordance with certain embodiments, the voltage of the first voltage source may be between approximately 1 and 20 V, such as between approximately 5 and 20 V, or between approximately 8 and 18 V. Indeed, the rate at which the current rises during the current maintenance period, represented by arrow 286 in FIG. 10, is dependent upon the voltage of the first voltage source 242. For example, in one embodiment, a higher voltage results in a faster increase in current, and a lower voltage results in a slower increase in current. Indeed, as is discussed below with respect to FIGS. 14-17, this relationship is exploited with respect to the second voltage source 244 to rapidly change the current through the coil 294.

Figure 12:
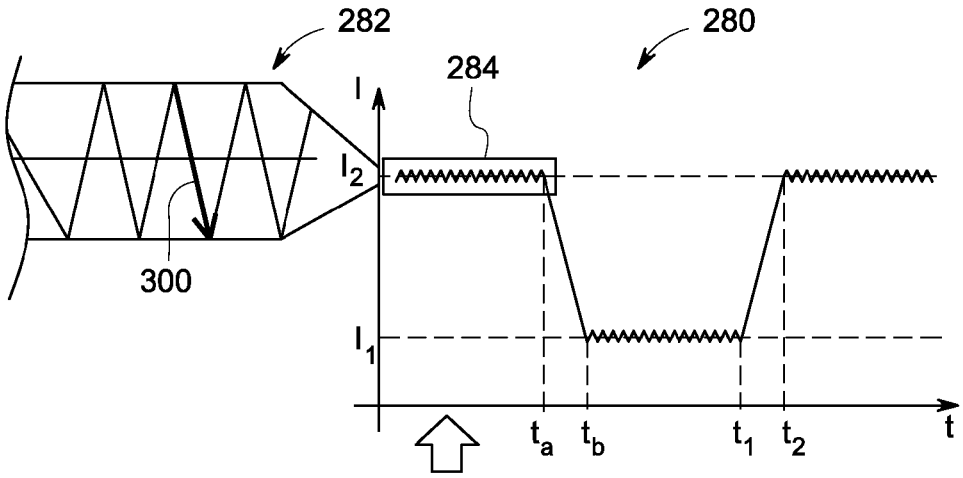
FIG. 12 is a plot illustrating an embodiment of a current profile through an electron beam manipulation coil as a function of time and an expanded view of a portion of the plot corresponding to the maintenance of an average current through the electron beam manipulation coil.
Figure 13:
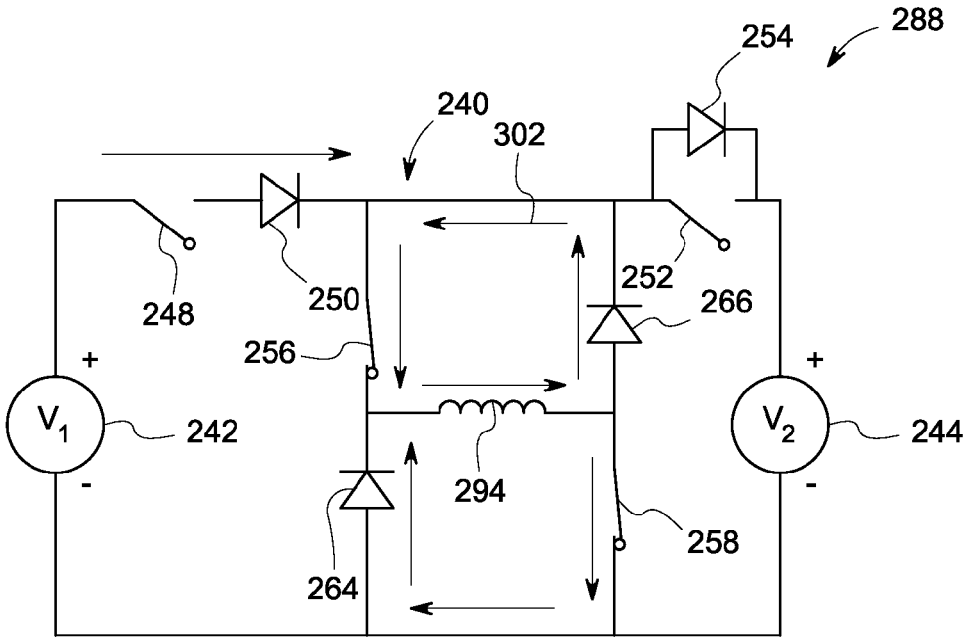
FIG. 13 is a schematic illustration of an embodiment of the control circuit of FIG. 9 in a configuration that causes a current dissipation loop to form to cause a current through the electron beam manipulation coil to slowly dissipate.

Referring now to FIG. 12, the expanded view 282 depicts a period of current reduction, illustrated as an arrow 300, during the current maintenance procedure. The configuration of the circuit 240 during this period is illustrated in FIG. 13. Specifically, FIG. 13 depicts the first switching device 248 in its open position. Accordingly, no current is able to flow from the first voltage source 242 to the coil 294. Additionally, the second switching device 252 is in the open position 244, preventing conduction from the second voltage source 244 to the coil 294 via the second switching device 252. Rather than allowing conductance from the voltage sources 242, 244 to the coil 294 when in their closed positions, in the configuration illustrated in FIG. 13, the third and fourth switching devices 256, 258 form a current dissipation loop 302, whereby current is allowed to flow through the coil 294 without encountering a power source. Accordingly, due at least to the parasitic resistance of the coil 294 and the third and fourth switching devices 256, 258, the current flowing through the coil is reduced over time, and results in a current reduction at a second rate, which is illustrated by the arrow 300 of FIG. 12. In some embodiments, the second rate may be dependent at least on the magnitude of these parasitic resistances.

Figure 14:
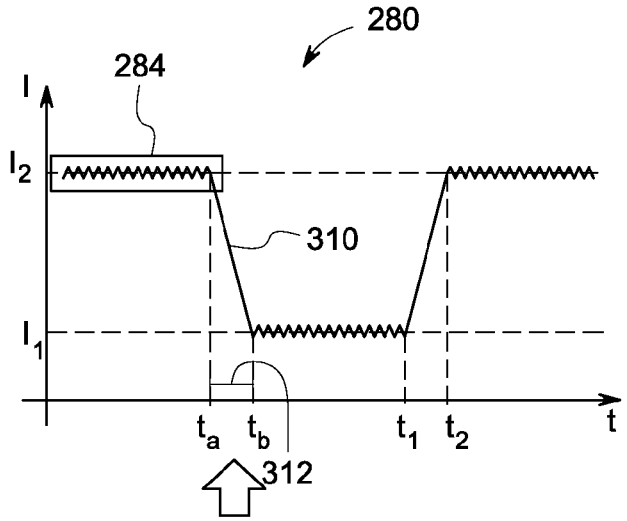
FIG. 14 is a plot illustrating an embodiment of a current profile through an electron beam manipulation coil as a function of time and referring to a transition from a global average maximum current to a global average minimum current.

Moving to the current profile 280 illustrated in FIG. 14, the profile 280 depicts, after the current maintenance period of box 284, a decrease 310 from $I_2$, the average global maximum current, to $I_1$, the average global minimum current, within a timeframe 312. As may be appreciated with reference to FIG. 14, the decrease 310 is at a rate that causes the decrease from $I_2$ to $I_1$ to occur much faster than would be obtained using the current dissipation loop 302 illustrated in FIG. 13. The configuration of the circuit 240 corresponding to the decrease 310 is illustrated in FIG. 15.

Figure 15:
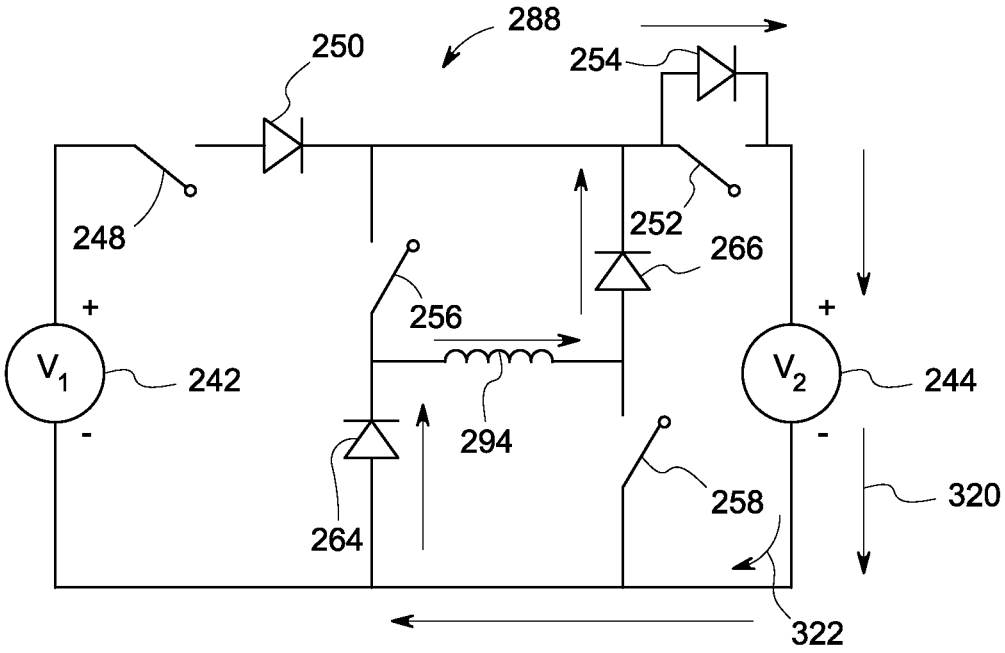
FIG. 15 is a schematic illustration of an embodiment of the control circuit of FIG. 9 in a configuration that causes a second current to pass through the electron beam manipulation coil.

Specifically, FIG. 15 depicts all of the active switching devices, i.e. devices 248, 252, 256, and 258 in their respective open positions. Due to the positioning of the second, third, and fourth diodes 254, 264, and 266, conductance is only enabled in a manner which causes a second current 320 to flow via a second current path 322 from the second voltage source 244 to the coil 294. In the second current path 322, the second current 320 flows from the anode of the second voltage source 244, through the coil 294, and to the cathode of the second voltage source 244, which causes the current flowing through the coil 294 to begin reversing polarity. This reversal is represented as the current decrease 310 in FIG. 14. Indeed, the rate of the decrease 310 is dependent at least upon the magnitude of the potential placed upon the circuit 240 by the second voltage source 244, which is directly dependent on the voltage of the second voltage source 244. In this way, the voltage of the second voltage source 244 can affect the rate of the decrease 310 (FIG. 14). Accordingly, in embodiments where it may be desirable to reduce the current level as quickly as possible, it may be desirable to have the highest possible voltage at the second voltage source 244. In accordance with certain embodiments, such as embodiments where the electron beam manipulation coil 298 has a relatively small inductance, the voltage of the second voltage source 244 may be between approximately 50 and 200 V, such as between approximately 100 and 175 V, or between approximately 120 and 160 V. Alternatively, in embodiments where the electron beam manipulation coil 298 has a relatively large inductance, the voltage of the second voltage source 244 may be between approximately 200 and 500 V, such as between approximately 250 and 450 V, 275 and 400 V, or between approximately 300 and 375 V.

Indeed, a number of factors may affect the rate at which the current is reduced from $I_2$ to $I_1$, which can also affect what voltage may be desirable for the second voltage source 244. For example, the parasitic resistance of the coil 294 and the diodes 254, 264, and 266 may affect the rate and/or the desired voltage at the second voltage source 244. Indeed, the total parasitic resistance of the configuration illustrated in FIG. 15 may relate to the total time in changing the current through the coil 294 from $I_2$ to $I_1$. For example, in one embodiment, the parasitic resistance of the configuration illustrated in FIG. 15 may be related to the voltage drops experienced by the current 320 as it passes from the second voltage source 244 to the coil 294 via the following equation:

$$\Delta t1_{Fall} = L \cdot \frac{I_H}{(V_{Average} + \Delta_{Fall})} \tag{1}$$

where $\Delta t1_{Fall}$ is the timeframe 312, L is the inductance of the coil 294, $I_H$ is the second current, $V_{Average}$ is the average voltage of the configuration in FIG. 15, and $\Delta_{Fall}$ is the change in voltage in the configuration as the current through the coil 294 is switched from $I_2$ to $I_1$. In one embodiment, $V_{Average}$ is calculated using equation (2):

$$V_{Average} = V_H + \frac{3}{2} \cdot (V_{Diode} - V_{Switch}) \tag{2}$$

where $V_{Diode}$ is the change in voltage experienced by the second current 320 across each diode and $V_{Switch}$ is the change in voltage experienced by the second current 320 across each switching device. Additionally, $\Delta_{Fall}$ is calculated using equation (3):

$$\Delta_{Fall} = V_{Delta} + R_{p2} \cdot \frac{2}{3} \cdot I_H \tag{3}$$

where $V_{Delta}$ is the change in voltage from $I_2$ to $I_1$ and $R_{p2}$ is the parasitic resistance of the circuit 240 in its configuration of FIG. 15. In one embodiment, $R_{p2}$ is calculated using equation (4):

$$R_{p2} = R_L + 3 \cdot Rd_{Diode} \tag{4}$$

where $R_L$ is the parasitic resistance of the coil 294, and $3 \cdot Rd_{Diode}$ is the total parasitic resistance experienced by the second current 320 as it flows through the three diodes 254, 264, and 266. Using the foregoing equations 1-4, the present embodiments provide the timeframe 312 in which the control circuit 240 is maintained in the configuration illustrated in FIG. 15. The determination using the equations above may provide an indication as to an appropriate voltage for the second voltage source 244 for a given timeframe 312, or may provide an indication as to the timeframe 312 that will result from a given voltage of the second voltage source 244. In this way, either voltage or time may be fixed.

Figure 16:
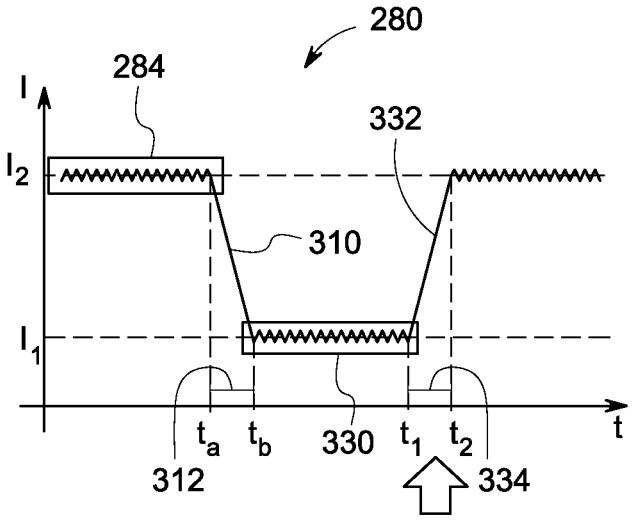
FIG. 16 is a plot illustrating an embodiment of a current profile through an electron beam manipulation coil as a function of time and referring to a transition from a global average minimum current to a global average maximum current.

As illustrated in FIG. 16, after the current through the coil 294 is reduced from $I_2$ to $I_1$ using the second voltage source 244, the control circuit 240 performs a current maintenance routine as described with respect to FIGS. 10-13. However, the current maintenance routine is a second current maintenance routine 330 performed for a lower current level, i.e., at $I_1$. It should therefore be noted that the duty cycle, or the amount of time spent by the first switching device 248 in its respective open and closed positions at $I_1$, may be different than the duty cycle at $I_2$. For example, in the illustrated embodiment, because $I_1$ is at a lower current level than $I_2$, the duration in which the first switching device 248 is closed may be shorter than the duration in the closed position for $I_2$.

Figure 17:
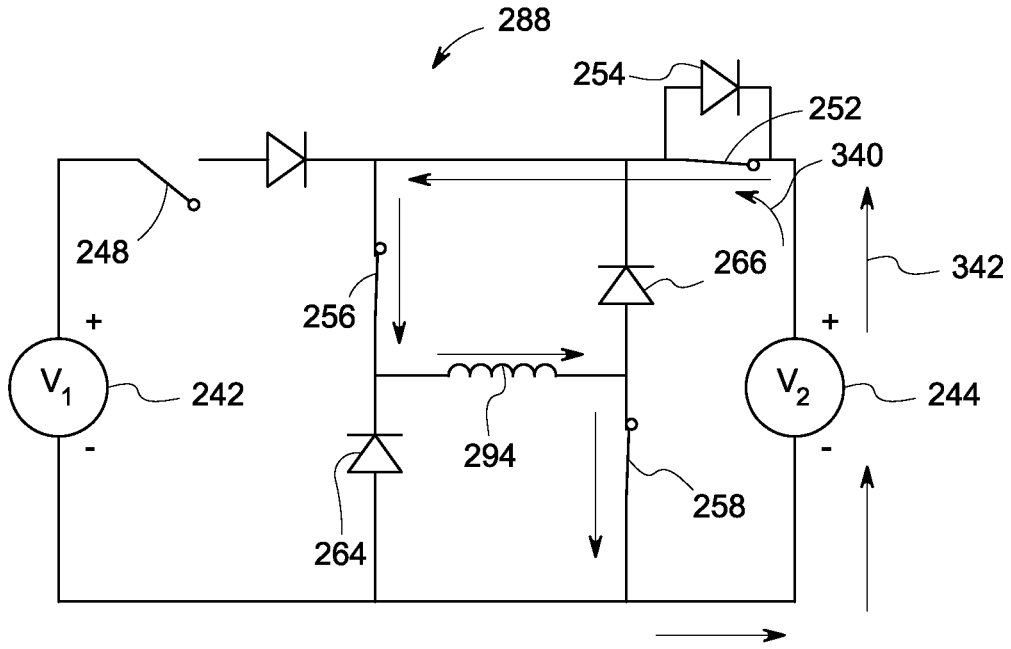
FIG. 17 is a schematic illustration of an embodiment of the control circuit of FIG. 9 in a configuration that causes a third current to pass through the electron beam manipulation coil.

After the second current maintenance period 330, the current through the coil 294 is then switched from $I_1$ back to $I_2$ in a current increase 332. Specifically, the current is increased from $I_1$ to $I_2$ during a second timeframe 334. During the second timeframe 334, the second voltage source 244 conducts current to the coil 294 via the second switching device 252. This configuration of the circuit 240 is illustrated in FIG. 17. In the arrangement 288 of FIG. 17, the second switching device 252 is in its closed position, which forms a third current path 340. Moreover, because the third switching device 256 and the fourth switching device 258 are in their respective closed positions, a current loop is formed between the coil 294 and the second voltage source 244. The third current path 340 enables a third current 342 to flow from the second voltage source 244 toward the coil 294. The current loop, indicated by the arrows in FIG. 17, enables the third current 342 to flow through the third switching device 256, and to the coil 294. In the configuration illustrated in FIG. 17, the third current 342 flows from the anode of the second voltage source 244, through its cathode, and to the coil 294. Therefore, the third current 342 has a polarity that is opposite from the polarity of the second current 320 described with respect to FIG. 15. In this way, the polarity of the third current 342 performs the opposite function with respect to the second current 320 in FIG. 15.

The second timeframe 334 during which the circuit 240 increases the current through the coil 294, for example to increase the magnitude of the magnetic field generated by the coil 294, may depend on a number of factors similar to those described above with respect to the timeframe 312. For example, in the configuration of the circuit 240 in FIG. 17, the third current 342 flows through the second, third, and fourth switching devices 252, 256, and 258, as well as the coil 294. While the resistance of these features may help to reduce the timeframe 312 because they facilitate the dissipation of current during the current reduction phase, the same dissipation may act to reduce the rate at which the current is increased during the current increasing phase.

Indeed, in a manner similar to that described above for timeframe 312, the parasitic resistance of the coil 294 and the switches 252, 256, and 258 may affect the rate and/or the desired voltage at the second voltage source 244. Thus, the total parasitic resistance of the configuration illustrated in FIG. 17 may relate to (e.g., increase) the total time in changing the current through the coil 294 from $I_1$ to $I_2$. For example, in one embodiment, the parasitic resistance of the configuration illustrated in FIG. 17 may be related to the voltage drops experienced by the current 342 as it passes from the second voltage source 244 to the coil 294 via the following equation:

$$\Delta t1_{Rise} = L \cdot \frac{I_H}{(V_{Average} - \Delta_{Rise})} \tag{5}$$

where $\Delta t1_{Rise}$ is the second timeframe 334, L is the inductance of the coil 294, $I_H$ is the third current generated by the second voltage source 244, $V_{Average}$ is the average voltage of the configuration in FIG. 17, and $\Delta_{Rise}$ is the change in voltage in the configuration as the current through the coil 294 is switched from $I_1$ to $I_2$. In one embodiment, $V_{Average}$ is calculated using equation (6):

$$V_{Average} = V_H + \frac{3}{2} \cdot (V_{Diode} - V_{Switch}) \tag{6}$$

where $V_{Diod}$, is the change in voltage experienced by the third current 342 across each diode and $V_{Switch}$ is the change in voltage experienced by the third current 342 across each switching device. Additionally, $\Delta_{Rise}$ is calculated using equation (7):

$$\Delta_{Rise} = V_{Delta} + R_{p1} \cdot \frac{2}{3} \cdot I_H \tag{7}$$

where $V_{Delta}$ is the change in voltage from $I_1$ to $I_2$ and $R_{p1}$ is the parasitic resistance of the circuit 240 in its configuration of FIG. 17. In one embodiment, $R_{p1}$ is calculated using equation (8):

$$R_{p1} = R_L + 3 \cdot Rd_{Switch} \tag{8}$$

where $R_L$ is the parasitic resistance of the coil 294, and $3 \cdot Rd_{Switch}$ is the total parasitic resistance experienced by the third current 342 as it flows through the three switching devices 252, 256, and 258. Using the foregoing equations 5-8, the present embodiments provide the second timeframe 334 in which the control circuit 240 is maintained in the configuration illustrated in FIG. 17. The determination using the equations above may provide an indication as to an appropriate voltage for the second voltage source 244 for a given second timeframe 334, or may provide an indication as to the second timeframe 334 that will result from a given voltage of the second voltage source 244. In this way, either voltage or time may be fixed. It should be noted that the first timeframe 312 will be shorter than the second timeframe 334 due to the various parasitic resistances in the circuit 240. Specifically, the parasitic resistances facilitate current reduction and mitigate, at least to an extent, current increase.

Figure 18:
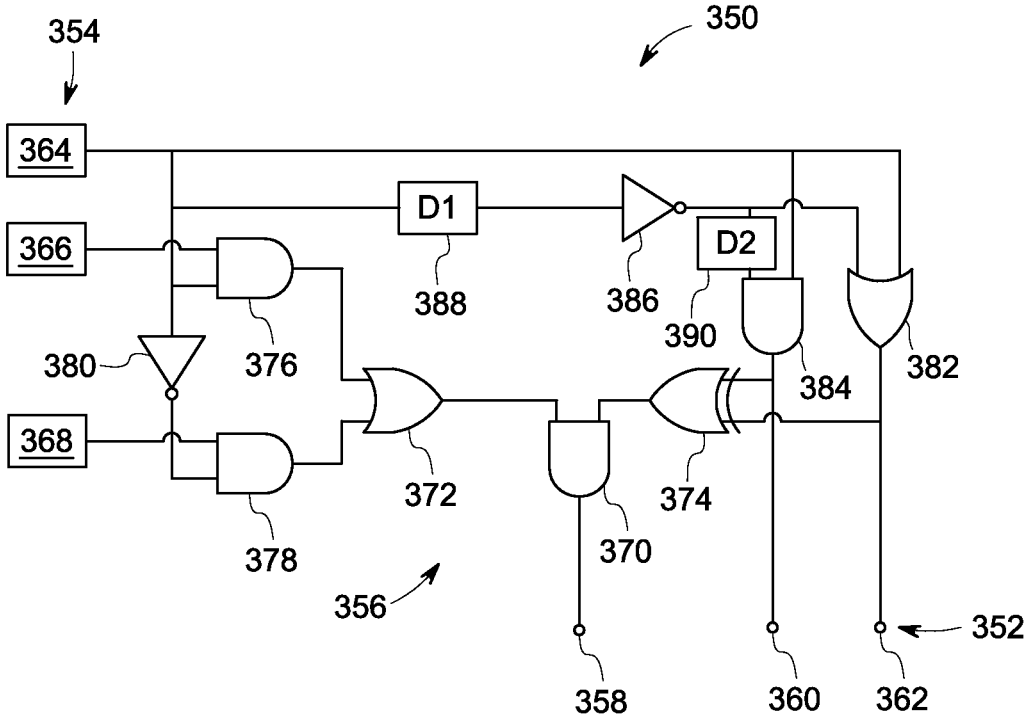
FIG. 18 is a schematic illustration of an embodiment of a control logic device, the device being configured to control the operation of switching devices within the control circuit of FIG. 9.

The calculation of these timeframes, i.e., the delay between current levels, may facilitate the control of the control circuit 240 using control logic. For example, these delays may be integrated into a control logic device to provide timing and control signals to the switching devices of the control circuit 240. Such timing and control signals may be used to vary the current flowing through the coil 294 and, when switching between current levels, voltage pulses for varying magnetic field magnitude. An embodiment of such a control logic device 350 is illustrated FIG. 18.

The control logic device 350 includes a series of logic outputs 352 that are driven by a series of logic clocks 354 and logic gates 356. It should be noted that while the logic gates 356 are illustrated as specific types of logic gates, the control logic device 350 may include other logic gates that perform, in concert, the operations performed by the disclosed gates. For example, NAND and NOR gates, which are considered universal gates, may be combined to perform the native operations of the illustrated logic gates. Indeed, any combination of logic gates capable of performing the functions described herein is presently contemplated. Moreover, the logic gates described herein may be constructed from any suitable device, such as a metal oxide semiconductor field effect transistor (MOSFET) device constructed using complimentary metal oxide semiconductor (CMOS) fabrication. Moreover, the logic gates may include n-type MOS (NMOS) logic, p-type MOS (PMOS) logic, or any combination thereof. In some embodiments, the logic gates described herein may be fully or partially implemented on a field programmable grid array (FPGA).

The logic outputs 352 each provide a binary signal (i.e., a 1 or a 0) to their respective switching devices of the circuit 240 to switch the devices between their open and closed positions. For example, in one embodiment, a "1" or a "high" signal may produce a closed position and a "0" or a "low" signal may produce an open position. The logic outputs 352 include a first logic output 358 that provides the control logic for the first switching device 248, a second logic output 360 that provides the control logic for the second switching device 252, and a third logic output 362 that provides the control logic for the third and fourth switching devices 256, 258, which operate in synchrony. The logic clocks 354 each control the timing of the signals provided to the switching devices via the logic outputs 352.

The logic clocks 354 include a first clock 364, a second clock 366, and a third clock 368. The first clock 364 controls the base operational frequency of the circuit 240, i.e., the frequency at which the control circuit 240 switches from $I_2$ to $I_1$, and from $I_1$ to $I_2$. Because the first clock 364 controls the base operational frequency, it provides input to each of the logic outputs 352. The second and third clocks 366, 368 control the duty cycle for the first switching device 248, such as when the current maintenance routines described above are performed. Specifically, the second clock 366 controls the duty cycle at $I_2$, and the third clock 368 controls the duty cycle at $I_1$. Because the second and third clocks 366, 368 control the duty cycles, they only provide input to the first control logic output 358, which controls the first switching device 248.

In the illustrated embodiment, the first switching device 248 is controlled by all three of the clocks 354. For example, the first logic output 358 is determined by a first AND gate 370, which combines logic outputs from the first clock 364 and a combination of the second and third clocks 366, 368. Specifically, the first AND gate 370 operates on inputs from a first OR gate 372 and an XOR gate 374. Accordingly, in embodiments where a high signal leads to a closed position of the first switching device 248, the output of the first OR gate 372 and the XOR gate 374 must both be high.

The first OR gate 372 includes two inputs, one which is produced from the second clock 366 and the other which is produced from the third clock 368. The first OR gate 372 receives a logic output from a second AND gate 376, which operates on input from the first and second clocks 364, 366. Similarly, the first OR gate 372 receives another logic output from a third AND gate 378. The third AND gate 378 operates on an input from the third clock 368, and on an input from the first clock 364 that has been inverted using a first NOT gate 380. Indeed, these logic gates are configured such that the inputs into the first OR gate 372 are mutually exclusive. That is, in embodiments where the first switching device 248 operates according to the second clock 366, it does not operate according to the third clock 368 due at least to the presence of the first NOT gate 380.

The XOR gate 374 also includes two inputs, one of which is from a second OR gate 382 and the other of which is from a fourth AND gate 384. As will be appreciated with reference to FIG. 18, the fourth AND gate 384 constitutes the second logic output 360 that controls the second switching device 252 and the second OR gate 382 constitutes the third logic output 362, which controls the third and fourth switching devices 256, 258. The second OR gate 382 receives a pair of inputs, one directly from the first clock 354, and the other being an input from the first clock 354 that has been inverted by a second NOT gate 386. As will be discussed in detail below, the inverted input form the second NOT gate 386 to the second OR gate 382 is delayed corresponding to a first delay 388, which may be implemented as a counter, for example as a staggered grid pin array (SPGA). The first delay 388, in one embodiment, corresponds to the first timeframe 312 discussed above.

In a similar manner to the second OR gate 382, the fourth AND gate 384 also receives an input directly from the first clock 364. However, the input that is inverted from the first clock 364 is twice delayed. That is, the other input for the fourth AND gate is an input that has gone through the first delay 388, through the second NOT gate 386, and through a second delay 390, which may also be a counter. As will be discussed in further detail below, the combination of the first and second delays 388, 390 may correspond, in one embodiment, to the second timeframe 334 discussed above.

Figure 19:
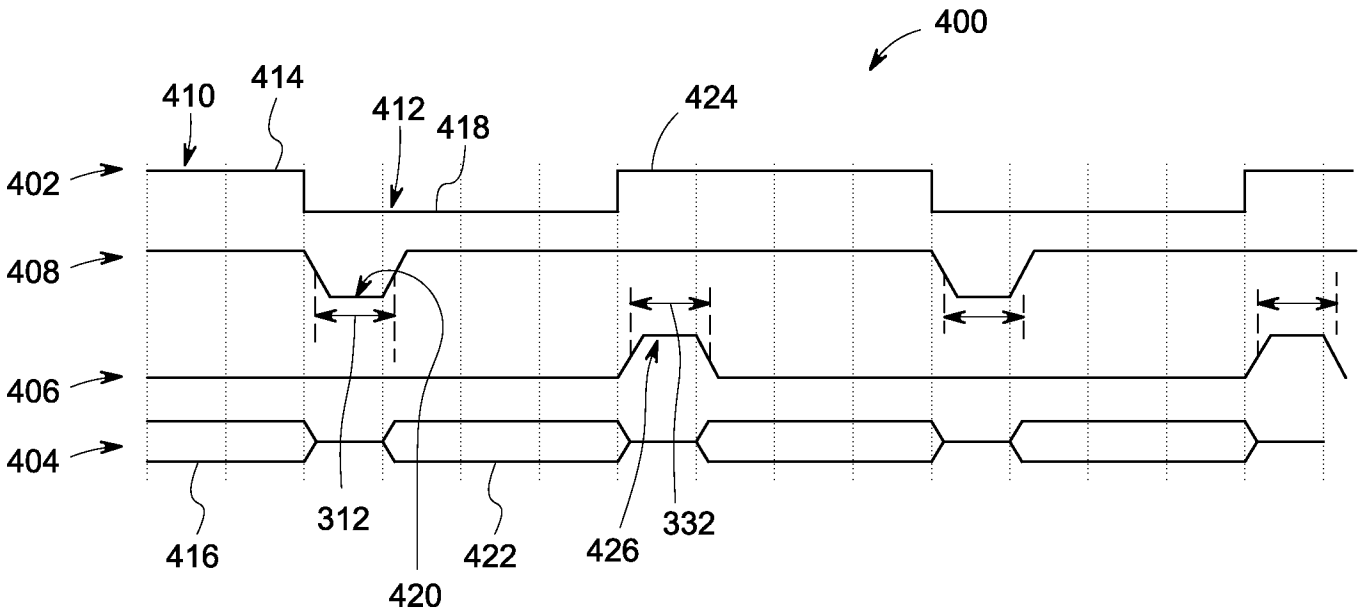
FIG. 19 is an illustration of an embodiment of a plot of control logic signals during the operation of the control circuit of FIG. 9.

Keeping in mind the configuration of the control circuit 240 and the control logic device 350 described above, the operation of the control logic device 350 will be described below with reference to FIG. 19, which is a combined plot 400 of logic signals produced by the first, second, and third clocks 364, 366, and 368. The plot 400 includes a base operational frequency clock output 402, a first logic signal provided to the first switching device 404, a second logic signal provided to the second switching device 406, and a third logic signal provided to the third and fourth switching devices 408. As illustrated in the plot 400, the signals provided to the active switches of the circuit 240 (FIG. 17) are provided in synchrony, which is due to the base operational frequency provided by the first clock 364 and the first and second delays 386, 388 in FIG. 18. In the context of the circuit 240 being connected to the coil 294, the first clock 364 controls the rate at which the coil 294 produces a relatively low magnitude magnetic field and a relatively high magnitude magnetic field.

Referring to the output of the first clock 364, the output 402 illustrates a step function of periods of high signal (e.g., a high voltage) 410, or a "1", and periods of low (e.g., a low voltage) 412, or a "0." This binary output is used to drive several of the logic gates 356 of the control logic device 350. For example, as the output 402 produces a first high signal 414, the logic gates connected to the first clock 364 receive a "1." As illustrated in the concomitant portion of the outputs 406 and 408, the output for the second switching device 406 is at a low, which keeps the second switching device 252 in an open position. Conversely, the output for the third and fourth switching devices 408 is at a high, which causes the third and fourth switching devices 256, 258 to be in respective closed positions. That is, these signals generally result in the configuration of the circuit 240 illustrated in either of FIG. 11 or 13, depending on the duty cycle of the first switching device 248. At the time period of the first high signal 414, the first switching device 248 operates at a duty cycle for the high current 416, i.e., $I_2$.

As the signal 402 steps down to a first low signal 418, the logic gates connected to the first clock 364 receive a "0." As a result of the presence of the first delay 388, which is between the first clock and the second OR gate 382, which outputs the logic control for the third and fourth switching devices 256, 258, the first low signal 418 initially results in the production of a low signal 420 (i.e., a "0") by the second OR gate 382. The low signal 420 causes the third and fourth switching devices 256, 258 to open for a time equal to the first delay 388. The concomitant configuration of the circuit 240 is illustrated in FIG. 15, where all active switching devices are open.

After the first delay 388, which, as noted above, is equal to the timeframe 312 of switching from $I_2$ to $I_1$, the "0" that has been delayed by the first delay 388 is inverted by the second NOT gate 386. The resulting high signal is provided to the second OR gate 382, which sends a control signal to the third and fourth switching devices 256, 258 to close. Additionally, after the first delay 388, the first switching device 248 begins performing a duty cycle for the low current 422, i.e., $I_1$. In this configuration, the third clock 368 controls the operation of the first switching device 248.

After the first low signal 418, the first clock 364 produces a second high signal 424. Because the first clock 364 is directly connected to the second OR gate 382, the third and fourth switching devices 256, 258 remain in their closed positions. Additionally, the second high signal 424 ceases the control of the first switching device 248 by the third clock 368. The control of the first switching device 248 by the second clock 366 is delayed by at least the first and second delays 388, 390. The operation of the second switching device 252 is controlled by the output of the fourth AND gate 384, which receives one input directly from the first clock 364 and another input from the second delay 390. It should be noted that the first and second delays 390 act to delay the inverted high signal (i.e., delay the output of a low signal) produced by the second NOT gate 386. Accordingly, during the time delay caused by the first and second delays 388, 390, which is equal to the second timeframe 332, the fourth AND gate 384 receives two high inputs, which causes the second switching device 252 to close due to a high input, represented as a high signal 426 in the plot 406. The configuration of the circuit 240 corresponding to these signals, which is configured to increase the current through the coil 294, is illustrated in FIG. 17. The foregoing process may be repeated so as to quickly manipulate an electron beam in an X-ray source, for example using one or more coils that are integrated with the control circuitry and control logic as described above.

In one embodiment of the logic 350, the values of the duty cycles 366 and 368, and the delays D1 and D2 are calculated by a mainframe computer based on the system parasitic elements and the desired current values. The desired current values are calculated starting from the desired magnetic fields and the size/geometry of the electron beam manipulating coils. The desired magnetic fields are calculated based on the particular exam/analysis to be performed and the geometry, energy, and intensity of the electron beam used for the exam/analysis. The frequency/period of the clock 364 is calculated based on the exam/analysis and the geometry, energy, and intensity of the electron beam.

Figure 20:
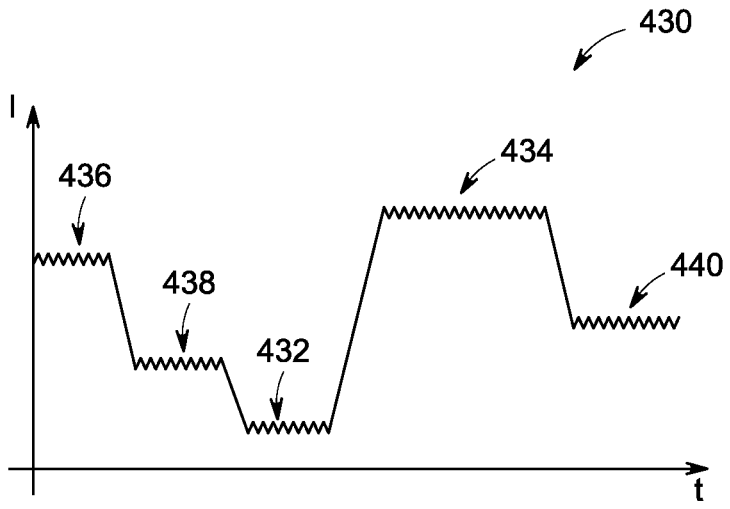
FIG. 20 is a plot illustrating an embodiment of a current profile through an electron beam manipulation coil as a function of time, the profile having a plurality of current levels between a value of a global average minimum current and a global average maximum current.

While the foregoing description depicts the current provided to the electron beam manipulation coil as varying between two current values, such as $I_1$ and $I_2$, the embodiments described herein can be extended to multiple current values as well. Specifically the embodiments described herein may be used to vary the current through the electron beam manipulation coil over a variety of current levels as depicted by FIG. 20, which illustrates a current profile 430. As illustrated, current profile 430 includes a plurality of current levels such as a global minimum current level 432, a global maximum current level 434, and first, second, and third current levels 436, 438, and 440. The first, second, and third current levels 436, 438, and 440 each have a current magnitude between the global minimum 432 and global maximum 434. During operation, for example, the control circuit 240 of FIG. 9 may be utilized to adjust the current provided to the electron beam manipulation coil 294 from a lower current to a higher current (e.g., from the global minimum 432 to the global maximum 434) using the topology configuration illustrated in FIG. 17. Conversely, the current may be changed from a higher current to a lower current (e.g., from the first current level 436 to the second current level 438) using the topology configuration illustrated in FIG. 15. The current at each of the illustrated levels may be maintained at the desired average level by an appropriate duty cycle value. The appropriate duty cycle value, in a general sense, is larger for larger currents and smaller for smaller currents (i.e., larger for first current level 436 than for the second current level 438).

Figure 21:
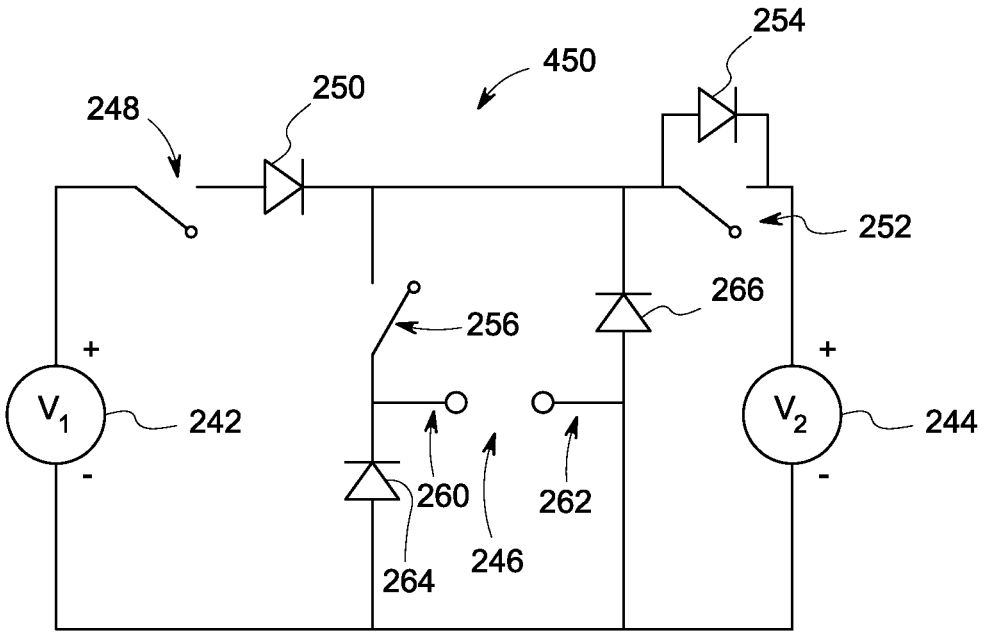
FIG. 21 is a circuit diagram illustrating another embodiment of a control circuit for driving an electron beam manipulation coil.

In accordance with certain embodiments described above, the control circuit 240 of FIG. 9 may be configured to perform current maintenance routines (e.g., by performing duty cycles with the first switching device 248), fast current increasing routines (e.g., using the second voltage source 244 and the second switching device 252), and fast current reduction routines (e.g., using the second voltage source 244 and the third and fourth switching devices 256, 258). However, in certain embodiments, it may be suitable to reduce the current through the electron beam manipulation coil 294 (FIG. 11) by cycling the current down using a similar topology to that illustrated in FIG. 13, rather than by performing a fast current reduction process as described above. Thus, in certain embodiments, the fourth switching device 258 may be removed from the circuit. An embodiment of such a circuit 450 is illustrated in FIG. 21. Specifically, the circuit 450 is capable of performing the current increasing and maintenance routines as described above, and is also capable of reducing current through the electron beam manipulation coil 294 (FIG. 11) using the parasitic resistance and other lossy mechanisms of the coil 450.

Figure 22:
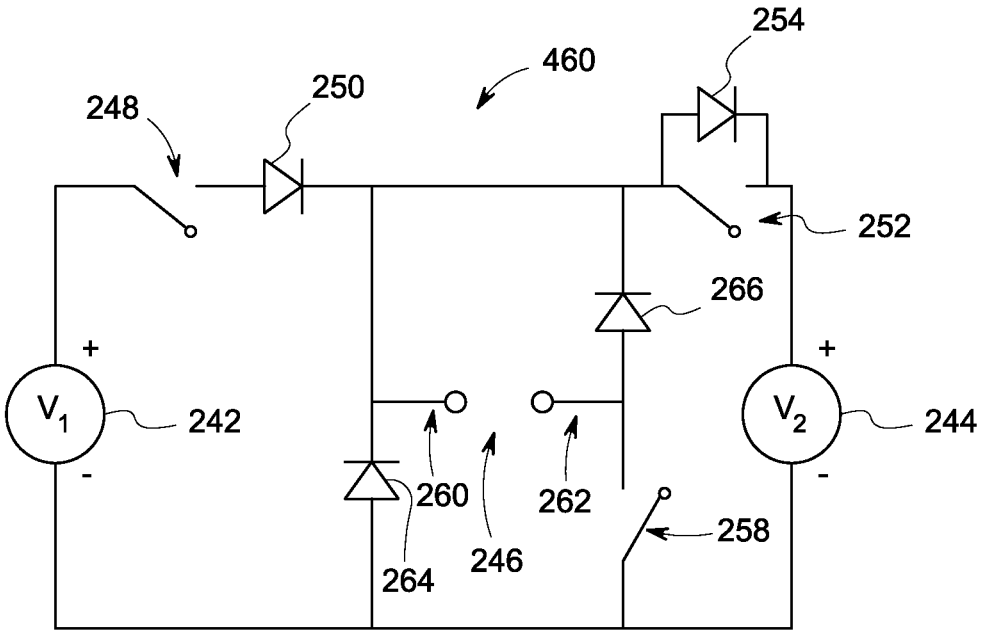
FIG. 22 is a circuit diagram illustrating another embodiment of a control circuit for driving an electron beam manipulation coil.

In an alternative approach to the circuit 450 of FIG. 21, the circuit 240 of FIG. 9 may be modified by removing the third switching device 256 rather than the fourth switching device 258, an embodiment of which is illustrated in FIG. 22. Specifically, FIG. 22 is a circuit diagram of an embodiment of a circuit 460 having three switching devices: the first, second, and fourth switching devices 248, 252, 258. As described above, the circuit 460 is capable of performing a number of current modification routines including current maintenance and fast current increase routines. Furthermore, the circuit 460 reduces current through the electron beam manipulation coil 294 by cycling the current down, rather than by using either of the first or second voltage sources 242, 244.

Figure 23:
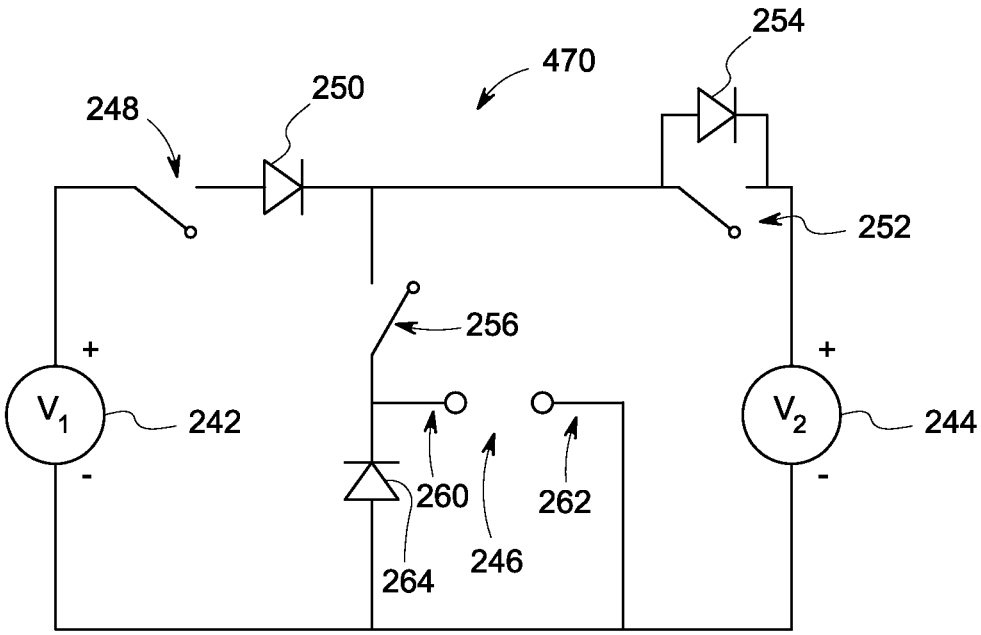
FIG. 23 is a circuit diagram illustrating an alternative embodiment of the circuit of FIG. 21.
Figure 24:
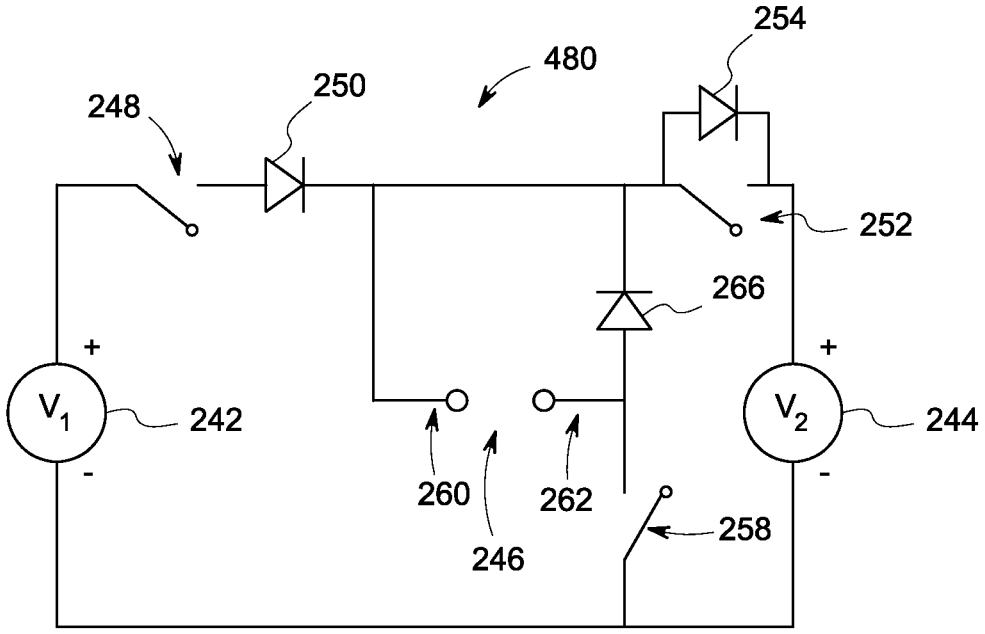
FIG. 24 is a circuit diagram illustrating an alternative embodiment of the circuit of FIG. 22.

Thus, the circuit 450 of FIG. 21 and the circuit 460 of FIG. 22 are generally configured to rapidly increase current through the electron beam manipulation coil 294, maintain the current through the electron beam manipulation coil 294, and cycle down the current through the electron beam manipulation coil 294 (as opposed to rapidly decreasing the current). In certain embodiments, it may be desirable to magnify the lossy mechanisms experienced by either of the circuits 450, 460 to enhance current reduction rates. Accordingly, in such embodiments, one or more of the diodes illustrated in FIGS. 21 and 22 may be removed. For example, the fourth diode 266 of the circuit 450 (FIG. 21) may be removed to enhance the losses experienced by the circuit 450 while the current through the electron beam manipulation coil 294 is cycled down. Such an embodiment is illustrated in FIG. 23 as a circuit 470. Likewise, the third diode 264 of FIG. 22 may be removed to similarly enhance the losses experienced by the circuit 460, which is illustrated as a circuit 480 in FIG. 24. Further modifications may include removing certain switching devices from either of circuits 470, 480. For example, the third switching device 256 of the circuit 470 of FIG. 23 may be replaced with a short. Likewise, the fourth switching device 258 of the circuit 470 of FIG. 24 may be replaced with a short.

With the foregoing in mind, it should be noted that the control circuit embodiments illustrated and described herein are examples. Thus other configurations capable of forming the current loops described herein for manipulating the current through an electron beam manipulation coil are also presently contemplated. The other configurations may therefore include the same number of electronic components (e.g., switching devices, diodes), fewer electronic components, or more electronic components than the embodiments presently described.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A controller, comprising:

a control circuit, comprising:

an interface adapted to receive an electron beam manipulation coil of an X-ray generation system;

a first switching device coupled to a first voltage source and configured to create a first current path with the first voltage source toward the electron beam manipulation coil;

a second switching device coupled to a second voltage source and configured to create a second current path with the second voltage source toward the electron beam manipulation coil; and a third switching device coupled to a first side of the interface and configured to allow conductance via the first current path and the second current path to the interface when the third switching device is in a closed position, wherein the second and third switching devices are configured to create a third current path with the second voltage source when in respective open positions, the third current path having an opposite polarity with respect to the second current path.

2. The controller of claim 1, wherein the control circuit comprises a fourth switching device coupled to a second side of the interface in parallel with the third switching device.

3. The controller of claim 2, wherein when the first switching device, the third switching device, and the fourth switching device are in respective closed positions and the second switching device is in an open position, a first current loop is created between the first voltage source and the electron beam manipulation coil.

4. The controller of claim 3, wherein the first switching device is adapted to maintain a current through the electron beam manipulation coil within a desired range using a duty cycle, the duty cycle comprising periods in which the first switching device is in the closed position and periods in which the first switching device is in an open position.

5. The controller of claim 4, wherein the third and fourth switching devices are in respective closed positions throughout the duty cycle.

6. The controller of claim 3, wherein the first current loop increases a current in the electron beam manipulation coil at a first rate up to a first maximum current, the first rate and the first maximum current are at least partially dependent on a voltage of the first voltage source, the duty cycle is variable to adjust the current through the electron beam manipulation coil over a plurality of current levels up to the first maximum current, and wherein the current through the electron beam manipulation coil depends at least on a duration of the periods of the duty cycle in which the first switching device is closed versus a duration of the periods of the duty cycle in which the first switching device is open.

7. The controller of claim 6, wherein when the second switching device, the third switching device, and the fourth switching device are in respective closed positions and the first switching device is in an open position, a second current loop is created between the second voltage source and the electron beam manipulation coil.

8. The controller of claim 7, wherein the second current loop increases the current in the electron beam manipulation coil at a second rate up to the first maximum current, and the second rate is at least partially dependent on a voltage of the second voltage source, and the voltage of the second voltage source is greater than the voltage of the first voltage source.

9. The controller of claim 7, wherein when the first and second switching devices are in respective open positions and the third and fourth switching devices are in respective closed positions, a third current loop and a fourth current loop are created between the third switching device and the electron beam manipulation coil and the fourth switching device and the electron beam manipulation coil, respectively.

10. The controller of claim 9, wherein the third and fourth current loops do not include a voltage source such that the current through the electron beam manipulation coil decreases at a third rate.

11. An X-ray system, comprising:

an X-ray source comprising a cathode assembly configured to emit an electron beam and an anode assembly configured to receive the electron beam, wherein the anode is adapted to generate X-rays in response to the received electron beam and the cathode assembly and anode assembly are disposed within an enclosure;

a plurality of electromagnetic coils disposed about the enclosure and configured to manipulate the electron beam by varying a dipole or quadrupole magnetic field generated by the plurality of coils; and a plurality of control circuits coupled to the plurality of electromagnetic coils, wherein each control circuit is coupled to one of the plurality of electromagnetic coils to independently control each coil, and each control circuit comprises:

a first voltage source; and a second voltage source, wherein the control circuit is configured such that the first voltage source is used to maintain a current through each coil within a desired range to maintain the dipole or quadrupole magnetic field, and the second voltage source is used to increase or decrease the current through the coil to change the dipole or quadrupole magnetic field.

12. The system of claim 11, wherein each control circuit comprises:

an interface adapted to receive one of the plurality of electromagnetic coils;

a first switching device coupled to the first voltage source and configured to create a first current path with the first voltage source toward the electromagnetic coil when in a closed position;

a second switching device coupled to the second voltage source and configured to create a second current path with the second voltage source toward the electromagnetic coil when in a closed position;

a third switching device coupled to a first side of the interface and configured to allow conductance via the first current path and the second current path to the electromagnetic coil when the third switching device is in a closed position; and a fourth switching device coupled to a second side of the interface in parallel with the third switching device, wherein the second, third, and fourth switching devices are configured to create a third current path with the second voltage source when in respective open positions, the third current path having an opposite polarity with respect to the second current path.

13. The system of claim 12, wherein when the first switching device, the third switching device, and the fourth switching device are in respective closed positions and the second switching device is in an open position, a first current loop is created between the first voltage source and the electromagnetic coil, the first current loop increases a current in the electromagnetic coil at a first rate up to a first maximum current, and the first rate and the first maximum current are at least partially dependent on a voltage of the first voltage source.

14. The system of claim 13, wherein the first switching device is adapted to maintain the current through the electromagnetic coil within the desired range using a duty cycle, the duty cycle comprising periods in which the first switching device is in the closed position and periods in which the first switching device is in an open position, wherein the third and fourth switching devices are in respective closed positions throughout the duty cycle.

15. The system of claim 13, wherein when the second switching device, the third switching device, and the fourth switching device are in respective closed positions and the first switching device is in an open position, a second current loop is created between the second voltage source and the electromagnetic coil, and the second current loop increases the current in the electromagnetic coil at a second rate up to the first maximum current, the second rate being at least partially dependent on a voltage of the second voltage source, and the voltage of the second voltage source is greater than the voltage of the first voltage source.

16. The system of claim 15, wherein when the first and second switching devices are in respective open positions and the third and fourth switching devices are in respective closed positions, a third current loop and a fourth current loop are created between the third switching device and the electromagnetic coil and the fourth switching device and the electromagnetic coil, respectively, and the third and fourth current loops are configured to reduce the current of the electromagnetic coil at a third rate.

17. The system of claim 12, comprising a plurality of control logic devices, each control logic device being coupled to each control circuit and configured to control the operation of the first switching device using a first logic output, the second switching device using a second logic output, and the third and fourth switching devices using a third logic output, wherein each logic output is determined by at least one logic gate.

18. The system of claim 17, wherein each control logic device comprises a first clock adapted to control a base operational frequency of the control circuit, the base operational frequency comprising a frequency at which the current through the electromagnetic coil is switched over a plurality of current levels between an average global minimum current and an average global maximum current.

19. The system of claim 18, wherein each control logic device comprises a first delay between the first clock and the second and third logic outputs and a second delay between the first delay and the second logic output, the first delay being adapted to keep the third and fourth switches in the closed position for a first transition time from the average global maximum current to the average global minimum current, and a combination of the first delay and the second delay are adapted to keep the second, third, and fourth switches in the closed position for a second transition time from the average global minimum current to the average global maximum current.

20. The system of claim 18, wherein each control logic device comprises a second clock adapted to control a first duty cycle frequency of the first switching device and a third clock adapted to control a second duty cycle frequency of the first switching device, the first duty cycle corresponding to the maintenance of the average global minimum current and the second duty cycle corresponding to the maintenance of the average global maximum current, wherein the first duty cycle frequency has a first ratio of the closed position duration to an open position duration, and the second duty cycle frequency has a second ratio of the closed position duration to the open position duration, and the first ratio is smaller than the second ratio.

21. A method of driving an electron beam manipulation coil, comprising the steps of:

closing a first switching device to cause a first current at a first polarity to flow along a first current path from a first voltage source toward the electron beam manipulation coil;

closing a second switching device to allow the first current to flow to the electron beam manipulation coil;

opening the first switching device after closing the first and second switching devices to stop the flow of the first current to the electron beam manipulation coil and to form a current dissipation loop configured to reduce a magnitude of a current through the electron beam manipulation coil; and opening the second switching device and a third switching device to cause a second current at a second polarity to flow along a second current path from a second voltage source to the electron beam manipulation coil.

22. The method of claim 21, comprising repeatedly performing the steps of closing the first switching device and opening the first switching device to maintain the current through the electron beam manipulation coil at an average magnitude that is lower than a maximum current available from the first voltage source.

23. The method of claim 21, comprising a step of closing a fourth switching device and the second and third switching devices to cause a third current at a third polarity to flow along a third current path from the second voltage source to the electron beam manipulation coil, wherein the first and third currents increase the current through the electron beam manipulation coil and the second current decreases the current through the electron beam manipulation coil.

24. The method of claim 23, comprising performing the step of opening the second switching device to transition from an average global maximum current through the electron beam manipulation coil to an average global minimum current in a shorter amount of time than would be achieved if the current through the electron beam manipulation coil were allowed to dissipate via the current dissipation loop.

25. The method of claim 23, comprising performing the step of closing the fourth switching device to transition from an average global minimum current through the electron beam manipulation coil to an average global maximum current in a shorter amount of time than would be achieved if the current through the electron beam manipulation coil were increased via the first current.

* * * * *